US007681406B2

(12) United States Patent
Cushman et al.

(10) Patent No.: US 7,681,406 B2
(45) Date of Patent: Mar. 23, 2010

(54) ICE-MAKING SYSTEM FOR REFRIGERATION APPLIANCE

(75) Inventors: Robert L. Cushman, Sunrise Beach, MO (US); David L. Hall, Piedmont, SC (US); James Scoville, Anderson, SC (US); James R. Holland, Gowen, MI (US); Andrea Bertolaccini, Cerreto Guidi (IT); Stefano Zuccolo, Sacile PN (IT); Enrico Favretti, Codogne' (IT); Huang Hsin, Orange (AU)

(73) Assignee: Electrolux Home Products, Inc., Cleveland, OH (US)

( * ) Notice: Subject to any disclaimer, the term of this patent is extended or adjusted under 35 U.S.C. 154(b) by 499 days.

(21) Appl. No.: 11/331,732

(22) Filed: Jan. 13, 2006

(65) Prior Publication Data

US 2007/0163282 A1 Jul. 19, 2007

(51) Int. Cl.
*F25C 1/12* (2006.01)

(52) U.S. Cl. ..... 62/72; 62/200; 62/344; 62/352

(58) Field of Classification Search ..... 62/340–356, 62/198–200, 511, 72
See application file for complete search history.

(56) References Cited

U.S. PATENT DOCUMENTS

| | | | | |
|---|---|---|---|---|
| 2,145,773 | A | 1/1939 | Muffly | |
| 2,145,775 | A | 1/1939 | Muffly | |
| 2,291,826 | A | 8/1942 | Muffly | |
| 2,359,780 | A | 10/1944 | Muffly | |
| 2,493,488 | A | 1/1950 | Jordan et al. | |
| 2,544,394 | A | 3/1951 | Muffly | |
| 2,866,322 | A * | 12/1958 | Muffly | 62/137 |
| 3,788,089 | A * | 1/1974 | Graves | 62/137 |
| 4,083,196 | A * | 4/1978 | Karll | 62/200 |
| 4,184,339 | A | 1/1980 | Wessa | |
| 5,212,957 | A * | 5/1993 | Ruff | 62/124 |
| 5,231,847 | A | 8/1993 | Cur et al. | |
| 5,375,432 | A * | 12/1994 | Cur | 62/320 |
| 6,735,959 | B1 * | 5/2004 | Najewicz | 62/3.63 |
| 7,201,014 | B2 * | 4/2007 | Hornung | 62/347 |
| 7,201,015 | B2 * | 4/2007 | Feldman et al. | 62/347 |
| 7,287,397 | B2 * | 10/2007 | Coulter et al. | 62/338 |

(Continued)

FOREIGN PATENT DOCUMENTS

| | | | |
|---|---|---|---|
| CA | 1598451 | A | 3/2005 |

(Continued)

*Primary Examiner*—William E Tapolcai
(74) *Attorney, Agent, or Firm*—Pearne & Gordon LLP

(57) ABSTRACT

An ice-making system is adapted to operate within a section of a refrigeration appliance where the ice-making system and the ice made in the ice-making system are exposed to a temperature greater than zero degrees Centigrade. When installed in the fresh food compartment of a refrigerator that also has a freezer section compartment, the refrigeration system furnishes a cooling effect to the freezer compartment sufficient to maintain the freezer compartment at a temperature of zero degrees or less and separately furnish to the ice-making unit a cooling effect sufficient to freeze water for making ice in the ice-making unit of the ice-making system. The ice-making system can include a reservoir that is operatively associated with the ice-making unit of the ice-making system for delivering water to the ice-making unit and for receiving water returned from the ice-making unit.

58 Claims, 8 Drawing Sheets

U.S. PATENT DOCUMENTS

| | | | |
|---|---|---|---|
| 7,406,838 | B2 | 8/2008 | Wang |
| 2005/0061009 | A1 | 3/2005 | Flinner et al. |
| 2006/0179869 | A1 | 8/2006 | Lee et al. |

FOREIGN PATENT DOCUMENTS

| | | | |
|---|---|---|---|
| CN | 1683884 | A | 10/2005 |
| DE | 103 36 830 | | 3/2005 |
| DE | 103 36 834 | | 3/2005 |
| JP | 2000009372 | | 1/2000 |
| JP | 2000011129 | | 1/2000 |
| WO | WO 2004/092661 | | 10/2004 |

* cited by examiner

ICE-MAKING SYSTEM FOR REFRIGERATION APPLIANCE

BACKGROUND OF THE INVENTION

The present invention relates generally to an ice-making system. In particular, the invention relates to an ice-making system, and associated refrigeration system, for a refrigeration appliance such as a domestic refrigerator that has both a freezer compartment and a fresh food compartment, with the ice-making system being located in the fresh food compartment of the refrigerator.

Refrigeration appliances, such as domestic refrigerators, typically have both a fresh food compartment, or section, where food items such as fruits, vegetables and beverages are stored and a freezer compartment, or section, where food items that are to be kept in a frozen condition are stored. The refrigerators are provided with refrigeration systems that maintain the fresh food compartments at temperatures somewhat greater than, or above, zero degrees Centigrade and the freezer compartments at temperatures below zero degrees Centigrade.

The arrangements of the fresh food and freezer compartments with respect to one another in such refrigerators vary. For example, in some cases, the freezer compartment is located above the fresh food compartment and in other cases the freezer compartment is located below the fresh food compartment. Additionally, many modern refrigerators have their freezer compartments and fresh food compartments arranged in a side-by-side relationship. Whatever arrangement of the freezer compartment and the fresh food compartment is employed, typically, separate access doors are provided for the compartments so that either compartment may be accessed without exposing the other compartment to the ambient air.

The refrigeration systems for such refrigerators usually include an evaporator for the freezer compartment that cools the air in the freezer compartment of the refrigerator to temperatures below zero degrees Centigrade. Air movers, such as fans for example, circulate the air in the freezer compartment for the purpose of bringing the cold air into contact with all sections of the freezer compartment.

The freezer compartment and the fresh food compartment are usually separated from one another by one or more partitions or mullions that are provided with at least one opening. The openings that are provided allow for the movement of air between the freezer and fresh food compartments under the influence of the air movers. In this way, cold air from the freezer compartment is circulated to the fresh food compartment for the purpose of maintaining the fresh food compartment at a temperature somewhat above zero degrees Centigrade.

Refrigerators of the types described often are provided with units for making ice or ice pieces. These ice-making units normally are located in the freezer compartments of the refrigerators and manufacture ice by the freezing of water by convection as the cold circulating air in the freezer compartments comes into contact with the water and by conduction as that same cold air cools the ice molds in which the water is held. Bins for storing the ice pieces that are made are often included with the ice-making units. The ice pieces can be dispensed from the storage bins through a dispensing port in the door that closes the freezer to the ambient air. The dispensing of the ice usually occurs by means of an ice delivery mechanism that extends between the storage bin and the dispensing port in the freezer compartment door.

In some cases, in particular with side-by-side refrigerators, a cold water dispensing system is provided. The container or reservoir that holds the water within the refrigerator in such a system is most often located in the fresh food compartment of the refrigerator. The water is dispensed from the container in the fresh food compartment through a conduit or tubing that extends to the dispensing port in the door of the freezer compartment through which the ice also is dispensed. Typically, the water line from the container to the dispensing port passes through the warm machinery section of the refrigerator before reaching the dispensing port.

SUMMARY OF THE INVENTION

The present invention, in one aspect, concerns an ice-making system that is adapted to operate within a section or compartment of a refrigeration appliance that is maintained at a temperature above, or greater than, zero degrees Centigrade such as the fresh food compartment of a refrigerator that also includes a freezer compartment. The ice-making system comprises an ice-making unit and a reservoir for holding water. The ice-making unit is adapted to be placed in operative association with a refrigeration system for furnishing to the ice-making unit a cooling effect sufficient to freeze water and form ice in the ice-making unit. The reservoir can be located within the same section or compartment of the refrigeration appliance as the ice-making unit and is adapted to be in fluid communication with a source of water outside the refrigeration appliance whereby water from the source of water maybe delivered to the reservoir. A valve, such as a float valve, can be provided for automatically controlling the delivery of water to the reservoir from the source of water outside the refrigeration appliance in response to the quantity of water in the reservoir. The reservoir is in fluid communication with the ice-making unit whereby water from the reservoir may be delivered to the ice-making unit, such as by a pump operatively connected to the reservoir and the ice-making unit, and water from the ice-making unit may be returned to the reservoir. The use of the ice-making system is not limited, however, to the fresh food compartment of a refrigeration appliance and has utility in other environments where the temperature of the air, to which the ice-making unit and the ice made in the ice-making unit are exposed is greater, than zero degrees Centigrade.

In a further aspect, the ice-making unit includes an ice-making tray in which ice pieces are formed and a collection area for collecting both excess water from the ice-making tray and ice pieces formed in the ice-making tray. The collection area includes at least one opening through which water may pass with the at least one opening being in fluid communication with the reservoir for returning water from the collection area to the reservoir. The ice-making unit of the ice-making system can include an ice storage area for holding ice pieces formed by the ice-making unit. The ice storage area can include at least one opening through which water can pass with the at least one opening being in fluid communication with the reservoir for returning water from the ice storage area to the reservoir. In a particular aspect, a device is provided for moving the ice pieces from the collection area to the storage area.

In still another aspect, the invention comprises a refrigeration appliance comprising a freezer compartment maintained at a temperature below zero degrees Centigrade and a fresh food compartment maintained at a temperature greater than zero degrees Centigrade. The freezer compartment and the fresh food compartment are in fluid communication with one another whereby air can be circulated between the freezer compartment and the fresh food compartment. An air mover, such as a fan for example, is provided for circulating the air between the freezer compartment and the fresh food compartment. The ice-making unit is located in the fresh food compartment of the refrigerator and the ice-making unit and the ice made in the ice-making unit are exposed to the temperature in the fresh food compartment. The refrigeration system for the refrigeration appliance is operatively associated with the freezer compartment of the refrigerator and the ice-making unit for furnishing to the freezer compartment a cooling effect sufficient to maintain the freezer compartment at a temperature of zero degrees Centigrade or less and for separately furnishing to the ice-making unit a cooling effect sufficient to freeze water and form ice in the ice-making unit. A heat-supplying arrangement can be placed in operative association with the ice-making unit for selectively furnishing to the ice-making unit a heating effect sufficient to free ice formed in the ice-making unit from any surface in the ice-making unit to which the ice may adhere.

In another aspect, the invention comprises a refrigeration system that is adapted to be used with a refrigeration appliance such as the refrigeration appliance described above. The refrigeration system comprises a refrigerant, a compressing unit for compressing the refrigerant and having an entry side and an exit side and a condensing unit for condensing the refrigerant after it has been compressed and having an entry side and an exit side. A first evaporator has an entry side in fluid communication with the exit side of the condensing unit and the first evaporator is adapted to be operatively associated with the freezer compartment for furnishing a cooling effect to the freezer compartment sufficient to maintain the freezer compartment at a temperature of zero degrees Centigrade or less. A second evaporator has an entry side in fluid communication with the exit side of the condensing unit, and the second evaporator is adapted to be operatively associated with the ice-making unit for furnishing a cooling effect to the ice-making unit sufficient to freeze water and form ice in the ice-making unit. The compressing unit can comprise a single compressor that is in fluid communication with both the first and second evaporators or it can comprise a first compressor in fluid communication with the first evaporator and a second compressor in fluid communication with the second evaporator. Additionally, the compressing unit can comprise a variable speed compressor, the speed and capacity of which are matched to the loads developed at the first and second evaporators. In a particular aspect, the refrigeration system includes a heat-supplying arrangement in the form of a fluid conduit that connects the exit side of the compressing unit and the entry side of the second evaporator for placing the exit side of the compressing unit in fluid communication with the entry side of the second evaporator whereby at least a portion of the refrigerant from the compressing unit can bypass the condensing unit and flow from the exit side of the compressing unit to the entry side of the second evaporator. A valve can be operatively associated with the fluid conduit for selectively opening and closing the fluid conduit to the flow of compressed refrigerant from the exit side of the compressing unit to the entry side of the second evaporator. This arrangement selectively furnishes to the ice-making unit a heating effect sufficient to free ice formed in the ice-making unit from any surface in the ice-making unit to which the ice may adhere. A control mechanism can be operatively associated with the valve located in the conduit for controlling the opening and closing of the valve for selected time periods.

According to another aspect, the refrigeration system includes a control valve for the second evaporator in operative association with the condensing unit and the second evaporator for selectively opening and closing off the flow of the refrigerant to the second evaporator from the condensing unit. Additionally, there can be provided a control valve for the first evaporator in operative association with the condensing unit and the first evaporator for selectively opening and closing off the flow of the refrigerant to the first evaporator from the condensing unit.

According to a further aspect, the refrigeration system includes a first capillary tube having an entry end and an exit end and a second capillary tube having an entry end and an exit end. The entry end of the first capillary tube is in fluid communication with the exit side of the condensing unit and the exit end of the first capillary tube is in fluid communication with the entry side of the first evaporator. The entry end of the second capillary tube is in fluid communication with the exit side of the condensing unit and the exit end of the second capillary tube is in fluid communication with the entry side of the second evaporator. In a particular aspect, the first capillary tube and the second capillary tube are of such respective sizes that the temperature of the refrigerant in the second evaporator is greater than the temperature of the refrigerant in the first evaporator.

According to even another aspect, a refrigeration appliance as described above can include a food or beverage storage unit that is located sufficiently proximate the reservoir so that the water reservoir is used to cool the storage unit. In a particular case, the reservoir includes walls that have inside surfaces that are in contact with and confine the water in the reservoir and outer surfaces. The walls of the reservoir are configured so that the storage unit is at least partially contained within the confines of the outer surfaces of the walls of the reservoir whereby the storage unit is cooled by the water reservoir. A fan operatively associated with the storage unit can be provided for circulating air within the storage unit.

According to a further aspect, a refrigeration appliance having an ice-making system as described above can include a door for closing off, as well as providing access to, the fresh food compartment. A dispensing port is provided in the door through which water can be selectively dispensed from the reservoir along a water-dispensing path. The water-dispensing path can be arranged so as to be located essentially entirely within the fresh food compartment of the refrigerator prior to entering the dispensing port.

In still another aspect of the present invention, a method is provided of operating a refrigeration appliance having a freezer compartment and a fresh food compartment in which an ice-making unit is located, the ice-making unit and the ice made in the ice-making unit being exposed to the temperature in the fresh food compartment. The freezer compartment and the fresh food compartment are in fluid communication with one another whereby air can be circulated between the freezer compartment and the fresh food compartment. The method comprises providing to the freezer compartment a cooling effect sufficient to maintain the freezer compartment at a temperature of zero degrees Centigrade or less and circulating the air between the freezer compartment and the fresh food compartment while maintaining the fresh food compartment at a temperature of greater than zero degrees Centigrade. The ice-making unit in the fresh food compartment is provided with a cooling effect separate from the cooling effect provided to the freezer compartment, the cooling effect provided to the ice-making unit being sufficient to freeze water and form ice in the ice-making unit. In a particular aspect, the cooling effect to the freezer compartment is provided by means of a first evaporator and the cooling effect to the ice-making unit is provided by means of a second evaporator. The cooling effect to the ice-making unit can be discontinued when ice is not being formed in the ice-making unit. In addition, the cooling effect to the freezer compartment can be discontinued for at least a portion of the time that the cooling effect is provided to the ice-making unit.

In another aspect, the method of operating a refrigeration appliance described above is carried out together with the method of making ice pieces in the ice-making unit. From a source of water, a pool of water is provided within an ice-making tray in the ice-making unit. A refrigerant is provided to a plurality of ice-forming elements that are disposed in the pool of water. The ice-forming elements are made of a material that is a thermal conductor and the refrigerant is at a temperature sufficiently low to freeze water in the vicinity of the ice-forming elements. Ice pieces are formed on the plurality of ice-forming elements. After the ice pieces are formed, any water that has not been made into ice is released or dumped from the ice-making tray. The ice pieces are then freed from the plurality of ice-forming elements. In a particular aspect, the ice pieces are freed from the plurality of ice-forming elements by providing to the ice-forming elements a refrigerant that is at a temperature sufficiently great enough to break the bond causing the ice pieces to adhere to the ice-forming elements. The ice pieces can also be freed by electrical resistance heating elements that are operatively associated with the ice-forming elements. In an additional aspect of the method of making ice pieces, the source of water can be a reservoir of water located in the fresh food compartment of the refrigeration appliance and at least a portion of the water released from the ice-making tray can be returned to the reservoir of water. Also, the water from the reservoir can be provided to the ice-making tray to an extent that the water overflows the ice-making tray and at least a portion of the water that overflows the ice-making tray can be returned to the reservoir of water.

In yet a further aspect of making ice pieces as described above, the freed ice pieces are allowed to fall and are initially collected in the collection area below the ice-making tray. The ice pieces can be moved from the collection area of the ice-making unit to an ice storage area in the fresh food compartment in which case any water resulting from the melting of the ice in the ice storage area is returned to the reservoir of water. Additionally, water from the water reservoir can be dispensed as drinking water and the water reservoir can be used to cool a food or beverage cooling unit.

BRIEF DESCRIPTION OF THE DRAWINGS

Wherever the same component appears in more than one figure of the drawings, it is identified in all the figures in which it appears by the same reference numeral.

DETAILED DESCRIPTION OF AN EMBODIMENT OF THE INVENTION

Figure 1:
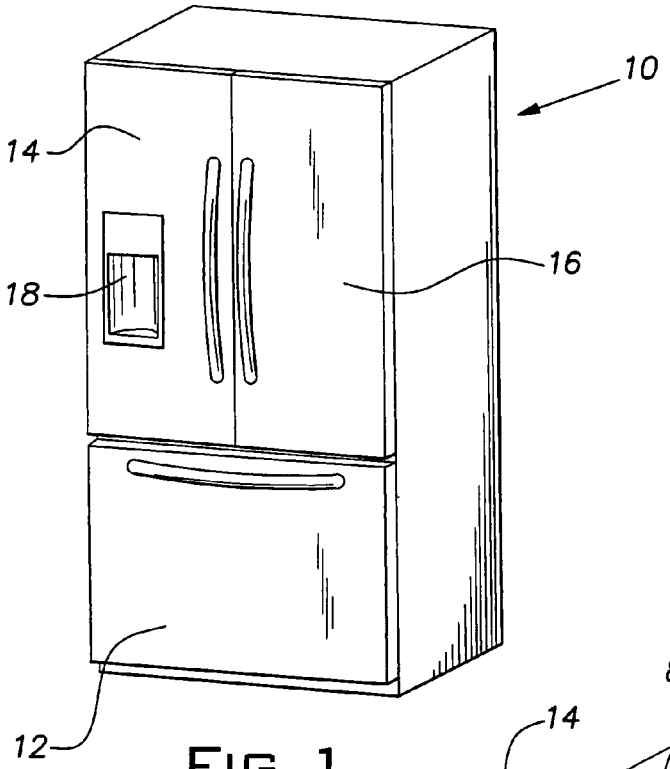
FIG. 1 is a perspective view of a refrigerator having a fresh food compartment and a freezer compartment and incorporating the principles of the present invention.

Referring to FIG. 1 there is illustrated a refrigeration appliance in the form of a domestic refrigerator, indicated generally at 10. Although the detailed description of an embodiment of the present invention that follows concerns a domestic refrigerator, it will be apparent to those of ordinary skill in the art based on the description that the invention can be employed other than with a domestic refrigerator.

The refrigerator 10 includes a freezer compartment or section located in the lower portion of the refrigerator, access to which is had through door 12. The freezer compartment is used to freeze and/or maintain articles of food stored in the freezer compartment in a frozen condition. For this purpose, the freezer compartment is maintained at a temperature of zero degrees Centigrade or less in a manner described below.

A fresh food compartment is located in the upper portion of the refrigerator 10. Access to the fresh food compartment is had through the double doors, or French doors, 14 and 16. The fresh food compartment serves to keep articles of food stored in the fresh food compartment from spoiling by maintaining the articles of food cool but at a temperature somewhat above zero degrees Centigrade so as not to freeze the articles of food. Water and ice can be dispensed through a recessed opening, or dispensing port, 18 located in double door 14.

In addition to being capable of being used with refrigeration appliances other than domestic refrigerators, the present invention can be employed with various types of domestic refrigerators and the use of the present invention is not limited to domestic refrigerators of the type specifically shown in FIG. 1. For example, the invention can be used in connection with a refrigerator that has the freezer compartment located in the upper portion of the refrigerator above the fresh food compartment that is located in the lower portion of the refrigerator. Additionally, the invention can be applied to a so-called side-by-side refrigerator where the freezer compartment is located on one side of the refrigerator and the fresh food compartment is located on the opposite side of the refrigerator. Typically, in the latter case, when facing the front of the refrigerator, the freezer compartment is located on the left-hand side of the refrigerator and the fresh food compartment is located on the right-hand side of the refrigerator, although the location of the freezer and fresh food compartments are reversed in some cases.

Figure 2:
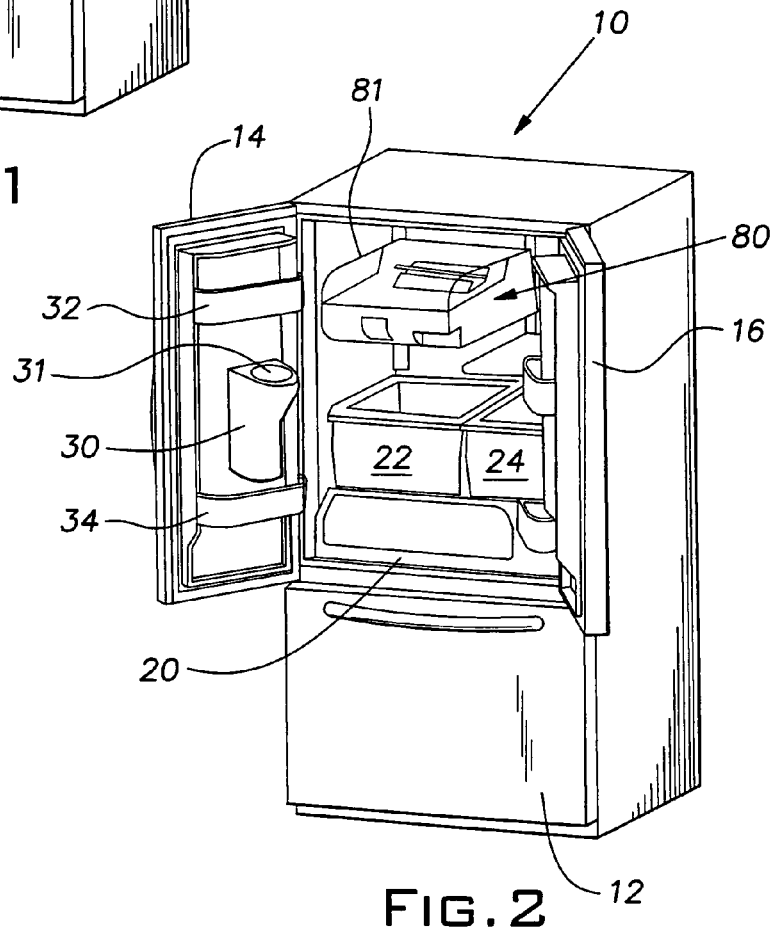
FIG. 2 is a perspective view of the refrigerator of FIG. 1 with the double doors of the fresh food compartment opened to show the manner in which the ice-making system of the present invention is arranged in relation to the other components of the fresh food compartment according to one embodiment of the invention.
Figure 3:
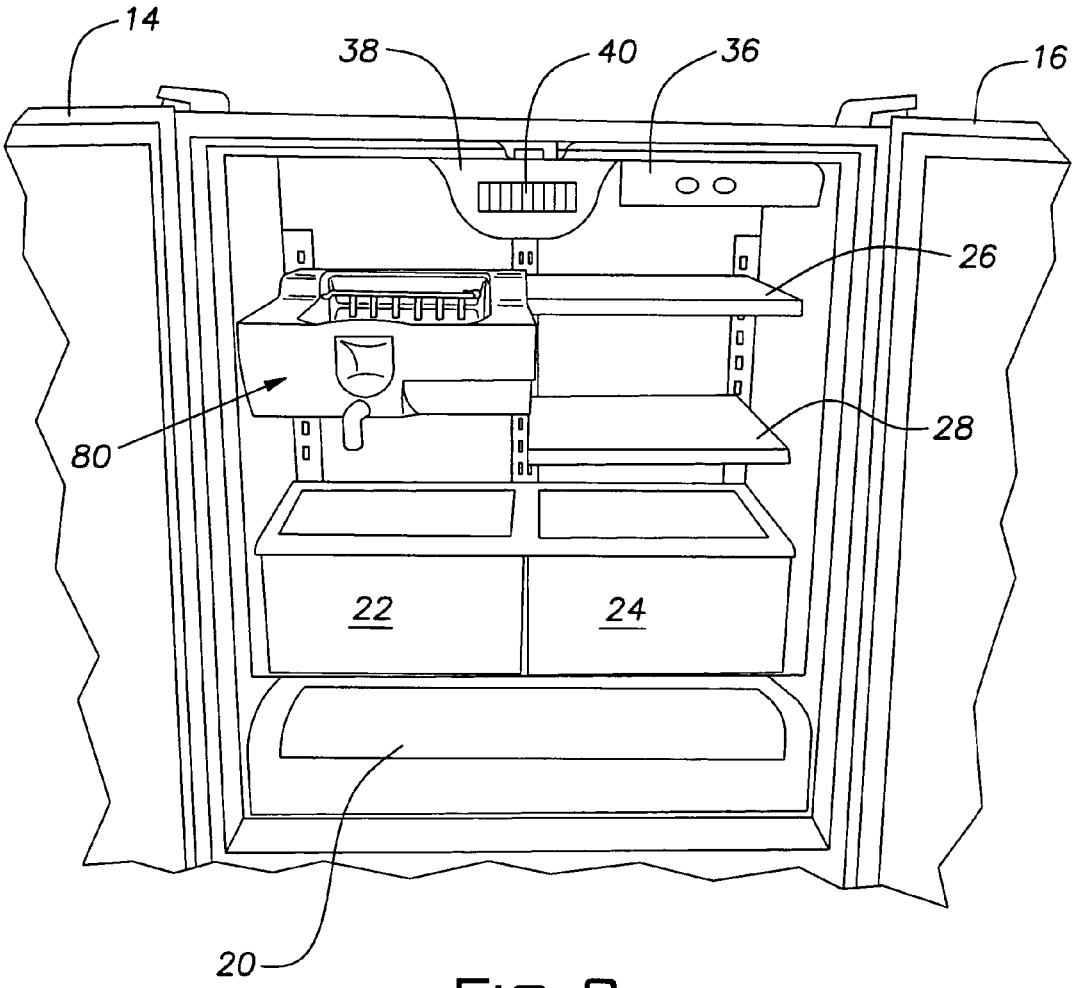
FIG. 3 is a perspective view of the inside of the fresh food compartment of the refrigerator of FIG. 1 which further illustrates the arrangement of the ice-making system in the fresh food compartment and depicts in greater detail certain features of the ice-making system.

FIG. 2 of the drawings illustrates the refrigerator 10 with the doors 14 and 16 of the fresh food compartment opened so as to show the manner in which the ice-making system of the present invention is arranged in relation to the other components of the fresh food compartment. FIG. 3 of the drawings also shows the interior of the fresh food compartment and the components therein, but on a larger scale than FIG. 2.

Referring to FIGS. 2 and 3, the fresh food compartment of the refrigerator is illustrated as including a food storage drawer 20 that extends across the width of the fresh food compartment. Two additional food storage drawers 22 and 24 are located side-by-side immediately above the drawer 20. In addition to the drawers for storing items of food, the fresh food compartment has two shelves 26 and 28 located above drawer 24 on which food items can be placed. The details of the manner in which the drawers 20, 22 and 24 are mounted within the fresh food compartment so that a user can slide the drawers outwardly of the fresh food compartment and return the drawers to the compartment interior and the manner in which the shelves 26 and 28 are secured to the rear of the fresh food compartment so that the vertical positions of the shelves within the fresh food compartment can be adjusted are not set forth here but are familiar to those having ordinary skill in the art.

Again with reference to FIGS. 2 and 3, the interior of the fresh food compartment contains an ice-making system, indicated generally at 80, that is secured within the fresh food compartment in any suitable manner. In the embodiment shown in the drawings, the ice-making system is secured to the rear wall of the fresh food compartment by means of slotted rails that are fastened to the rear wall and complementary hooks on the back of the ice-making system. As shown in FIG. 2, the ice-making system includes a cover 81 for the upper portion of the ice-making system. The cover is not shown in FIG. 3 so that the remainder of the ice-making system can be more clearly illustrated. The ice-making system and its operation are described in detail below. It can be noted here, however, that the ice-making system 80 is operationally associated with the dispensing port 18 by means of a dispensing conduit or funnel 30 for dispensing water and ice from the ice-making system to the dispensing port 18 when door 14 is closed. As shown in FIG. 2, the dispensing conduit 30 is mounted to the side of the double door 14 that faces the interior of the fresh food compartment when the door 14 is closed and includes an opening for receiving water as is described below. Also mounted on the side of the double door 14 that faces the interior of the fresh food compartment are shelves 32 and 34 that hold articles of food or beverages.

There also is illustrated in FIG. 3 a control panel 36 that is operationally associated with various control units and devices in the refrigerator. For example, the control panel can be used to provide input or control information to a microprocessor, not shown, that controls the operation of various components in the refrigerator including the ice-making system of the invention. Thus, the user can adjustably control various operational features of the refrigerator at the control panel. The functioning of the microprocessor is also responsive to condition-sensing devices, such as thermostats, located in the refrigerator.

Figure 4:
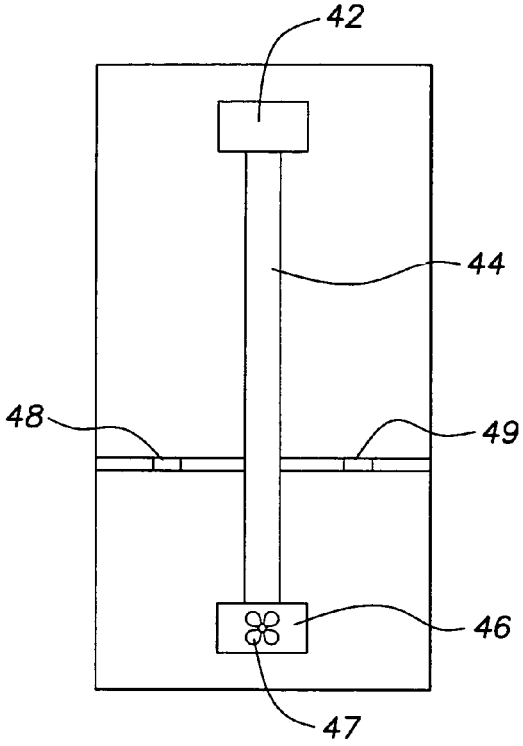
FIG. 4 is a somewhat schematic illustration of a rear elevational view of the refrigerator of FIGS. 1 and 2 and shows an embodiment of the arrangement by which the freezer compartment and the fresh food compartment of the refrigerator are in fluid communication for the purpose of circulating air between the two compartments.

The fresh food compartment of the refrigerator also includes, as best shown in FIG. 3, a panel 38 that is provided with a plurality of openings 40 through which air can flow. A diffuser assembly of the type familiar to those having ordinary skill in the art can also be used, in place of the panel 38 and openings 40, as a means through which air can flow. As shown somewhat schematically in FIG. 4, behind the panel 38 is an opening 42 in the rear wall of the fresh food compartment. An air duct 44 is in fluid communication with the opening 42 and extends from the opening 42 downwardly along the rear of refrigerator to an opening 46 in the rear wall of the freezer compartment. An air mover, such as a fan 47 in the illustrated embodiment, is located near or in opening 46 and moves air from the freezer compartment through the duct 44 from where the air flows through the opening 42 and the openings in the panel 38 to the fresh food compartment. Openings 48 and 49 are provided in the wall or mullion that separates the fresh food compartment from the freezer compartment. These openings allow air from the fresh food compartment to return to the freezer compartment. The freezer compartment and the fresh food compartment are thus in fluid communication with one another whereby air may be circulated between the freezer compartment and the fresh food compartment.

Louvers, not shown, can be installed over the opening 42 and/or the opening 46 to control the amount of air flowing from the freezer to the fresh food compartment in a manner familiar to those having ordinary skill in the art. The extent to which the louvers are opened at any time can be controlled by a servo device, the operation of which is controlled by the microprocessor in response to information provided by a thermostat that senses the temperature in the fresh food compartment.

Figure 10:
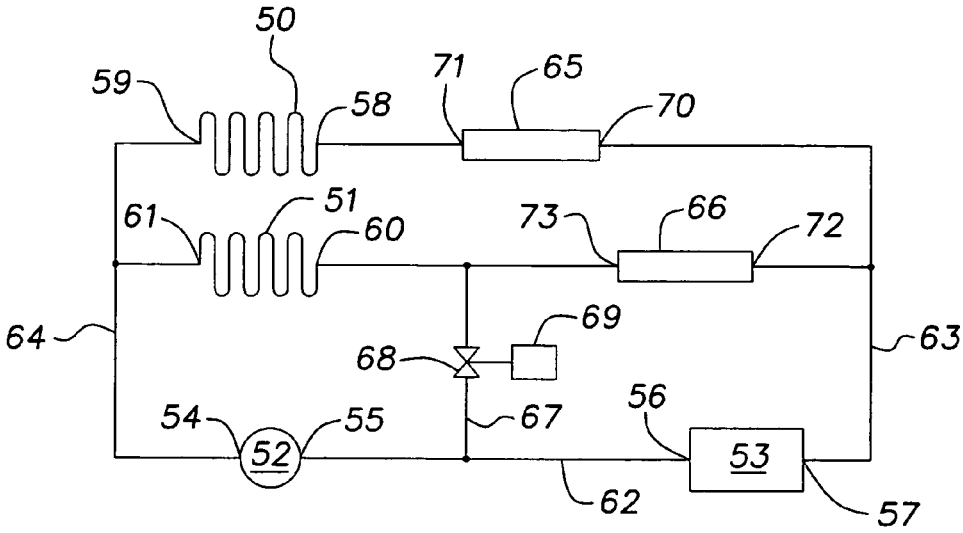
FIG. 10 is a schematic diagram of a first embodiment of a refrigeration system that can be employed with the ice-making system of the present invention.

The present invention, as embodied in the refrigerator 10 further comprises a refrigeration system schematically shown in FIG. 10. The refrigeration system is operatively associated with the freezer compartment and the ice-making system 80 for furnishing to the freezer compartment a cooling effect sufficient to maintain the freezer compartment at a temperature of less than zero degrees Centigrade, in some cases substantially less than zero degrees Centigrade, and for separately furnishing to the ice-making unit of the ice-making system 80 a cooling effect sufficient to freeze water and form ice in the ice-making unit.

More specifically with reference to FIG. 10, in the embodiment of the invention shown in the drawings, the refrigeration system includes a first evaporator 50 adapted to be operatively associated with the freezer compartment of the refrigerator for furnishing to the freezer compartment a cooling effect sufficient to maintain the freezer compartment at a temperature below zero degrees Centigrade. The evaporator 50 preferably is located inside the freezer compartment but need not be located there. The refrigeration system also includes, in the illustrated embodiment, a second evaporator 51 in operative association with the ice-making unit of the ice-making system 80 for furnishing to the ice-making unit a cooling effect sufficient to freeze water and form ice in the ice-making unit.

As illustrated in FIG. 10, the refrigeration system, in addition to the first evaporator and the second evaporator, includes a compressing unit 52 and a condensing unit 53. The refrigeration system also includes a suitable refrigerant such as HFC-134A for example. The compressing unit 52, for compressing the refrigerant, has an entry side 54 and an exit side 55 from which the compressed refrigerant exits the compressing unit. The condensing unit 53, for condensing the refrigerant after it has been compressed, includes an entry side 56 and an exit side 57 from which condensed refrigerant exits the condensing unit. The first evaporator 50 has an entry side 58 and an exit side 59 for the refrigerant and the second evaporator 51 has an entry side 60 and an exit side 61 for the refrigerant.

The exit side 55 of the compressing unit 52 is in fluid communication with the entry side 56 of the condensing unit 53 by means of a conduit 62. Each of the entry side 58 of the first evaporator 50 and the entry side 60 of the second evaporator 51 is in communication with the exit side 57 of the condensing unit by means of a conduit 63, for example. And each of the exit side 59 of the first evaporator 50 and the exit side 61 of the second evaporator 51 is in fluid communication with the entry side 54 of the compressing unit 52 by means of a conduit 64, for example.

A first capillary tube 65 is located between the exit side 57 of the condensing unit 53 and the entry side 58 of the first evaporator 50 so as to control the flow of the refrigerant to the first evaporator 50 from the condensing unit 53 and the temperature of the refrigerant in the first evaporator. In particular, the first capillary tube 65 has an entry end 70 and an exit end 71. The entry end 70 of the first capillary tube is in fluid communication with the exit side of the condensing unit 53 and the exit end 71 of the first capillary tube is in fluid communication with the entry side 58 of the first evaporator 50. A second capillary tube 66 is located between the exit side 57 of the condensing unit 53 and the entry side 60 of the second evaporator 51 so as to control the flow of the refrigerant to the second evaporator 51 from the condensing unit 53 and the temperature of the refrigerant in the second evaporator. In particular, the second capillary tube 66 has an entry end 72 and an exit end 73. The entry end 72 of the second capillary tube is in fluid communication with the exit end 57 of the condensing unit 53 and the exit end 73 of the second capillary tube is in fluid communication with the entry end 60 of the second evaporator 51. In the embodiment of the invention shown in FIG. 10, the first capillary tube 65 and the second capillary tube 66 are of such respective sizes that the temperature of the refrigerant in the second evaporator 51 is greater than the temperature of the refrigerant in the first evaporator 50. In this regard, it will be understood that the refrigerant as it enters the first and second capillary tubes is at a high temperature and pressure and the capillary tubes cause the refrigerant to expand as the refrigerant exits the capillary tubes thereby resulting in the vaporization and cooling of the refrigerant in the evaporators 50 and 51. The present invention is not limited to the use of capillary tubes and other types of regulators such as variable expansion devices, for example, can be employed. Additionally, a conduit 63 need not be used and the exit side 57 of the condensing unit may be connected directly, or through a dryer (not shown), to the entry ends 70 and 72 of the capillary tubes 65 and 66, respectively. Similarly, a conduit 64 need not be used and the entry side 54 of the compressing unit may be connected directly to the exit ends 59 and 61 of the evaporators 50 and 51 respectively.

The refrigeration system shown in the embodiment of the invention illustrated in FIG. 10 also includes a heat-supplying arrangement in operative association with the ice-making unit of the ice-making system 80 for selectively furnishing to the ice-making unit a heating effect sufficient to free ice formed in the ice-making unit from any surface in the ice-making unit to which the ice may adhere. More specifically, the heat-supplying arrangement comprises a fluid conduit 67 connected to the exit side 55 of the compressing unit 52 and the entry side 60 of the second evaporator 51 for placing the exit side 55 of the compressing unit 52 in fluid communication with the entry side 60 of the second evaporator 51 whereby at least a portion of the refrigerant from the compressing unit 52 may bypass the condensing unit 53 and flow from the exit side 55 of the compressing unit 52 to the entry side 60 of the second evaporator 51. A valve 68 is operatively associated with the fluid conduit 67 for selectively opening and closing the fluid conduit 67 to the flow of refrigerant from the exit side 55 of the compressing unit 52 to the entry side 60 of the second evaporator 51. A mechanism such as a servo device 69 is operatively associated with the valve 68 located in the conduit 67 for opening and closing the valve for selected time periods in response to control signals from the microprocessor in a manner described in more detail below. Input information to the microprocessor for this purpose can be provided at the control panel 36. Other means for supplying heat to the ice-making unit can be employed. For example, electrical resistors whose operation is controlled by the microprocessor based on input information provided at the control panel 36 can be used.

Figure 11:
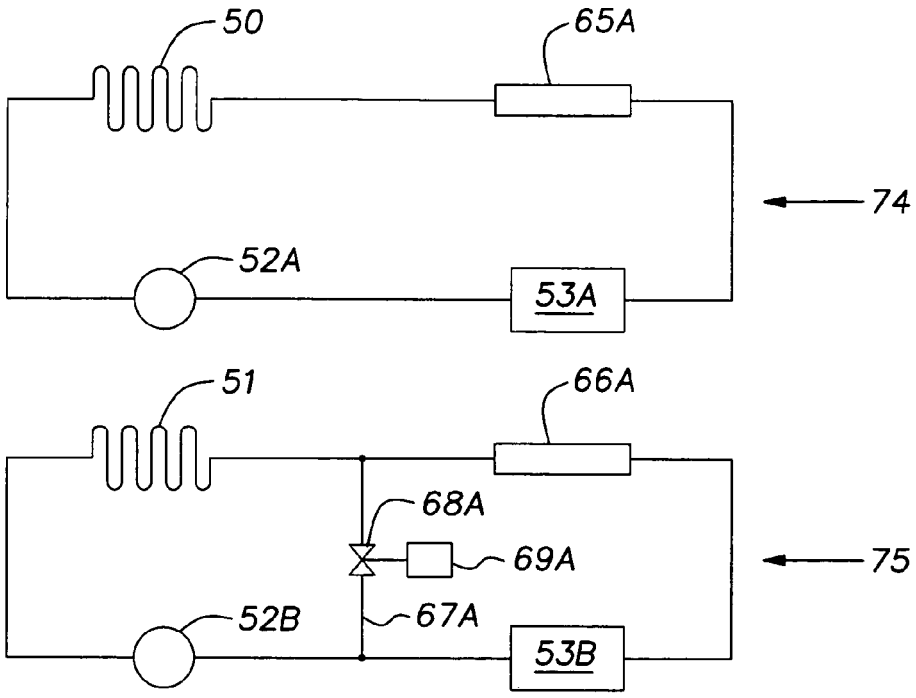
FIG. 11 is a schematic diagram of a second embodiment of a refrigeration system that can be employed with the ice-making system of the present invention.

In the embodiment of the invention shown in FIG. 10, the compressing unit 52 comprises a single compressor and the condensing unit 53 comprises a single condenser. Also in that embodiment, the refrigerant flows continuously through the first evaporator 50 and the second evaporator 51 and the amount of ice manufactured in the ice-making system 80 is controlled by controlling the frequency with which water is supplied to the ice-making system. However, as illustrated in FIG. 11, where a second embodiment of the refrigeration system is shown, the refrigeration system can comprise two independent refrigeration circuits. The compressing unit in that case comprises a first compressor 52A for a first refrigeration circuit, indicated generally at 74, wherein the first compressor 52A is in fluid communication with the first evaporator 50, and a second compressor 52B for a second refrigeration circuit, indicated generally at 75, wherein the second compressor 52B is in fluid communication with the second evaporator 51. Additionally, the condensing unit in this instance comprises a first condenser 53A for the first refrigeration circuit 74 and a second condenser 53B for the second refrigeration circuit 75. In addition, the first refrigeration circuit 74 includes a first capillary tube 65A between the condensing unit 53A and the evaporator 50, and the second refrigeration circuit 75 includes a second capillary tube 66A between the condensing unit 53B and the evaporator 51. Also included in refrigeration circuit 75 is a heat-supplying arrangement comprising a fluid conduit 67A connected to the exit side of the compressor 52B and the entry side of the second evaporator 51 for placing the exit side of the compressor 52B in fluid communication with the entry side of the second evaporator whereby at least a portion of the refrigerant from the compressor 52B may bypass the condensing unit 53B and flow from the exit side of the compressor 52B to the entry side of the second evaporator 51B. A valve 68A is operatively associated with the fluid conduit 67A for selectively opening and closing the fluid conduit 67A to the flow of refrigerant from the exit side of the compressor 52A to the entry side of the second evaporator 51. A mechanism such as a servo device 69A is operatively associated with the valve 68A located in the conduit 67A for opening and closing the valve for selected time periods in response to control signals from the microprocessor in a manner described in more detail below. Input information to the microprocessor for this purpose can be provided at the control panel 36. With the refrigeration system of FIG. 11, the refrigeration circuits 74 and 75 can be controlled independently by the microprocessor so that refrigeration circuit 74 is operated continually while refrigeration circuit 75 is operated only when ice is to be made or, alternatively, refrigeration circuit 74 can be idled when ice is being made by refrigeration circuit 75.

Figure 12:
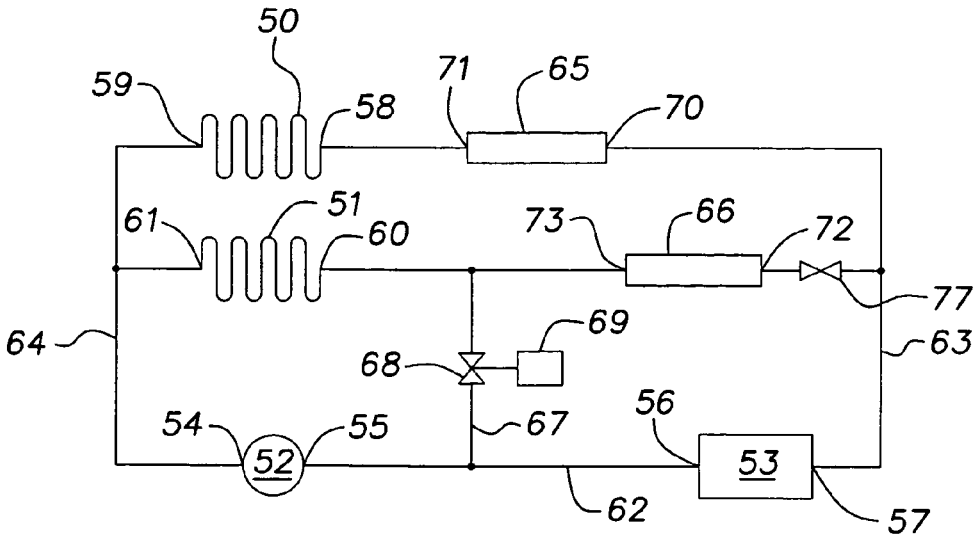
FIG. 12 is a schematic diagram of a third embodiment of a refrigeration system that can be employed with the ice-making system of the present invention.

In a third embodiment of the refrigeration system illustrated in FIG. 12, a control valve 77 for the second evaporator 51, and controllable by the microprocessor based on information that is input to the control panel 26, is added to the first embodiment of the refrigeration system shown in FIG. 11. The control valve 77 is operatively associated with the condensing unit 53 and the second evaporator 51 and controls the flow of the refrigerant through the capillary 66 to the second evaporator 51. Thus, by closing off the control valve 77, the cooling effect to the ice making unit is discontinued so that the ice will not be formed in the ice-making unit 80. In this case, therefore, the formation of ice can be controlled through the opening and closing of the control valve 77 and it is not necessary to also control the flow of water to the ice-making system as a means of controlling the ice-making activity.

Figure 13:
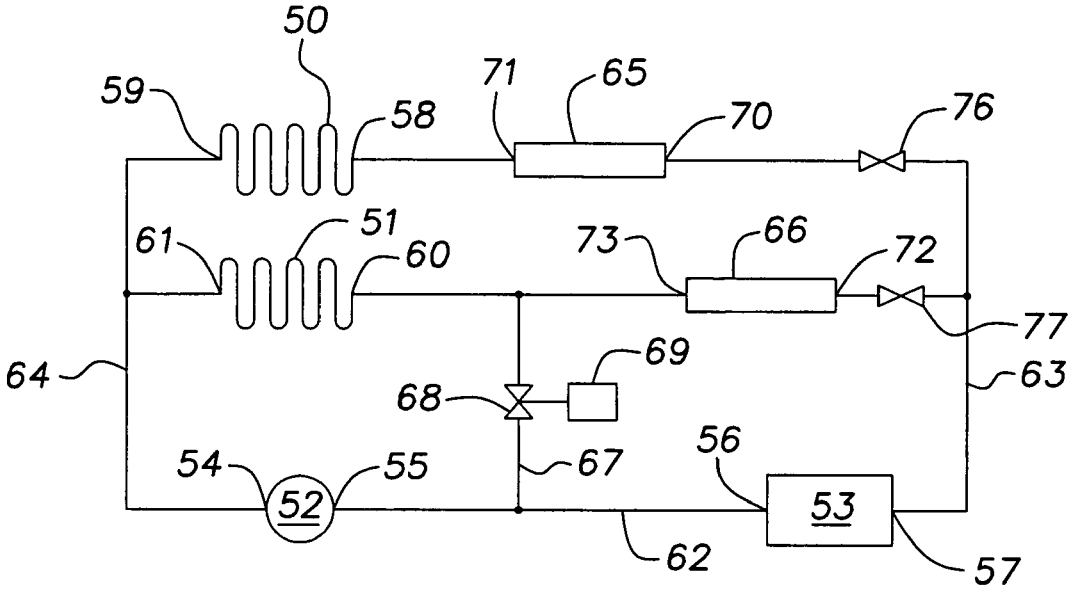
FIG. 13 is a schematic diagram of a fourth embodiment of a refrigeration system that can be employed with the ice-making system of the present invention.
Figure 14:
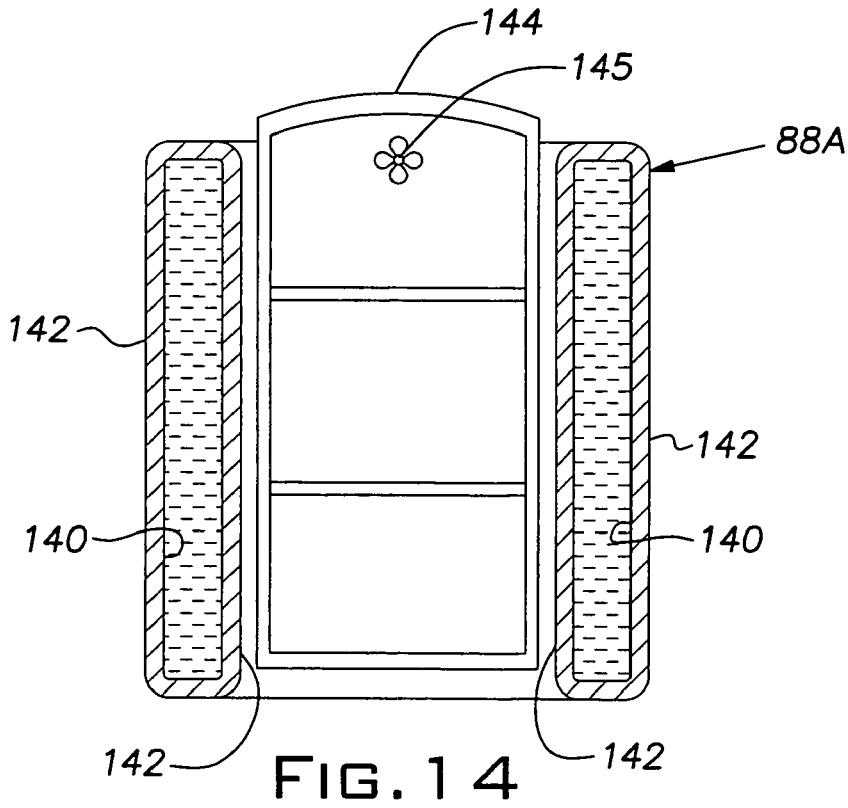
FIG. 14 is a front elevational view, partly in section, of an embodiment of the water reservoir of the ice-making system of the invention constructed and located in a fashion to cool a food or beverage cooler.

In a fourth embodiment of the refrigeration system illustrated in FIG. 13, in addition to the control valve 77, a control valve 76 for the first evaporator 50, that also can be controlled by the microprocessor based on information that is input to the control panel 26, is included in the system. The control valve 76 is operatively associated with the condensing unit 53 and the first evaporator 50 and controls the flow of the refrigerant through the capillary 65 to the first evaporator 50. As a consequence, the delivery of a cooling effect to the freezer compartment can be discontinued whenever desired such as, for example, at least a portion of the time that the control valve 77 is open, refrigerant is flowing to the second evaporator 51 and ice is being made. A refrigeration system similar to the system illustrated in FIG. 13, wherein separate control valves are provided for two evaporators, and which can be employed with the present invention, is disclosed in International Publication Number WO 2004/092661, having an international publication date of Oct. 28, 2004. The disclosure of International Publication Number WO 2004/092661 is incorporated herein by reference.

Whether a refrigeration system of the type illustrated in any of FIGS. 10 through 13 is employed, the compressing unit can comprise a variable speed compressor. In such compressors, the speed and capacity of the compressors are matched to the loads developed in the freezer compartment and the fresh food compartment, including the ice-making unit of the refrigerator.

Reference is now made to FIGS. 5 through 9 for a description of an embodiment of the ice-making system 80 of the present invention. The ice-making system comprises an ice-making unit and a reservoir for holding water for the ice-making unit. Operatively associated with the ice-making system is a refrigeration system that can be of the type described above, although other refrigeration systems can be employed with the ice-making system of the present invention.

Figure 8:
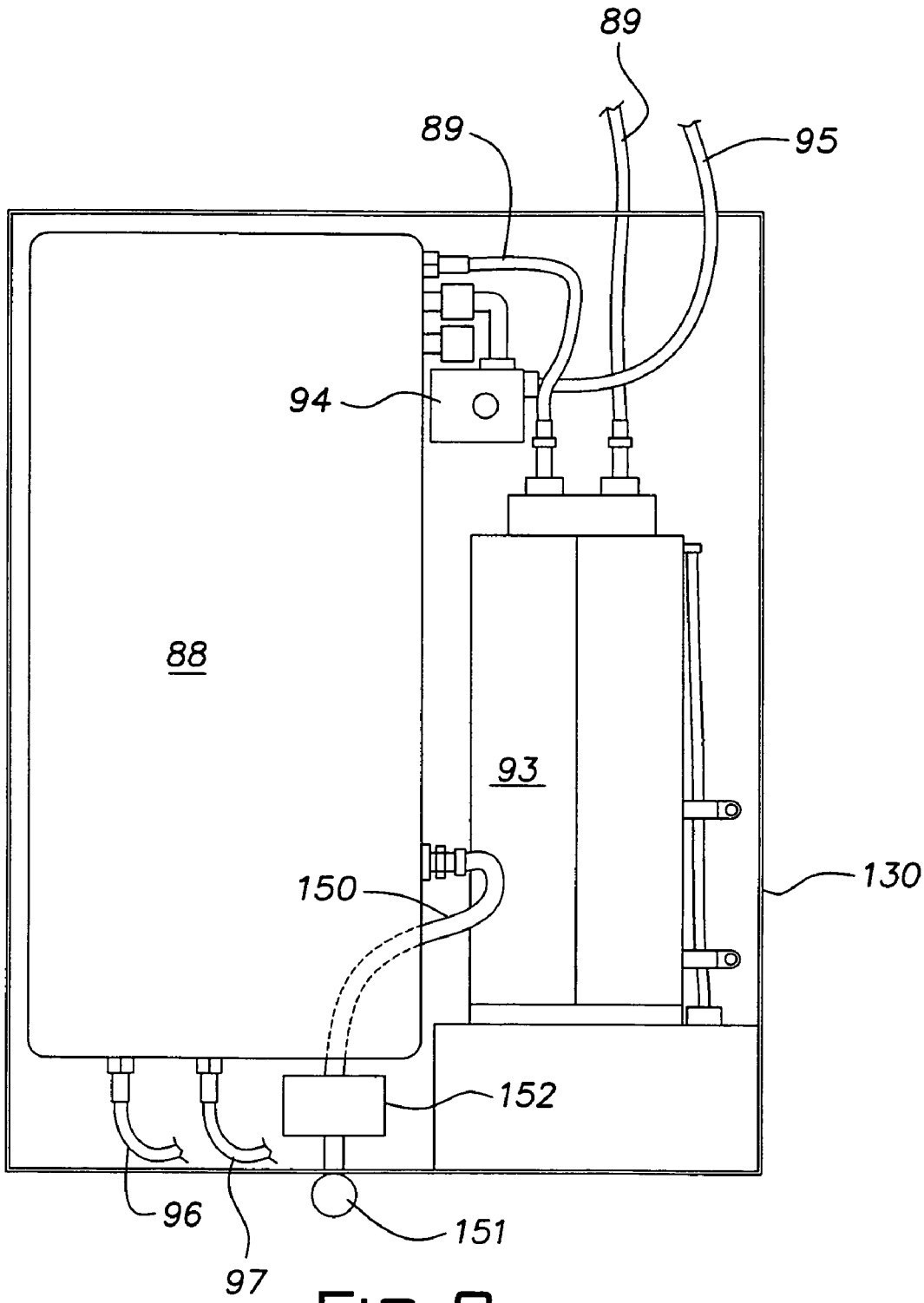
FIG. 8 is a top view of the embodiment of the ice-making system of FIGS. 6 and 7 shown with the upper section of the ice-making system removed to illustrate certain internal components of the ice-making system including the water reservoir from which water is supplied to the ice-making tray and to which water is returned from the ice-making unit
Figure 9:
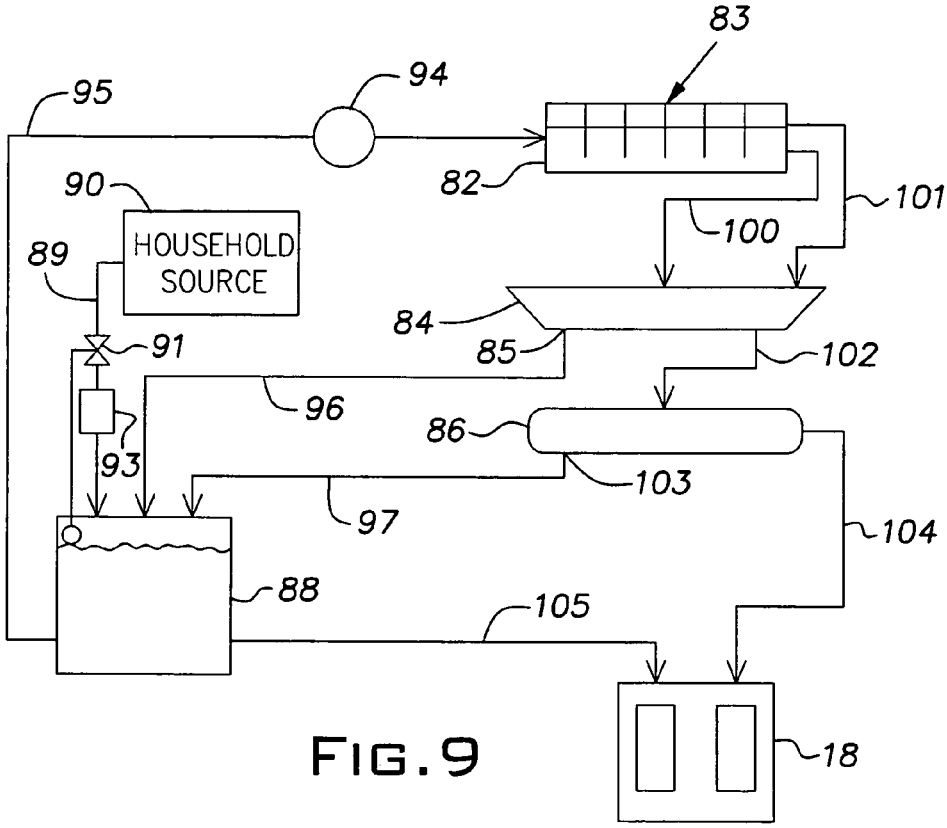
FIG. 9 is a schematic diagram that depicts the operational relationships that exist among the components of the embodiment of the ice making system of the present invention illustrated in FIGS. 5 through 8.

An overall operational description of the ice-making system 80 is best presented with reference to the schematic diagram of FIG. 9 of the drawings. The ice-making system, as schematically illustrated in FIG. 9, is adapted to operate within a section of a refrigeration appliance that is maintained at a temperature above zero degrees Centigrade, such as the fresh food compartment of the refrigerator 10 for example, where the ice-making unit of the ice-making system and the ice made by the ice-making unit are exposed to the temperature in the section of the refrigeration appliance that is maintained at a temperature above zero degrees. The ice-making unit of the ice-making system 80 is adapted to be placed in operative association with a refrigeration system, such as the refrigeration systems described above, for furnishing to the ice-making unit a cooling effect sufficient to freeze water and form ice in the ice-making unit. The embodiment of the ice-making unit that is a part of the ice-making system illustrated in FIGS. 6 through 8 comprises an ice-making tray 82 in which ice is formed around ice-making elements 83; a collection area 84; and an ice storage area 86. The ice-making unit may optionally include the cover 81 shown in FIG. 2. In addition to the ice-making unit, the ice-making system includes a reservoir 88 for holding water.

As shown in FIG. 9, the reservoir 88 is adapted to be in fluid communication with a source of water, such as a household water system 90, outside the refrigeration appliance whereby water from the source of water may be automatically delivered to the reservoir, such as through a water line 89 when the quantity of the water in the reservoir falls below a preselected level. The ice-making system also includes a float valve 91 that is operatively associated with the reservoir and the source of water 90 outside the refrigeration appliance 10, for controlling the quantity of water in the reservoir in a manner familiar to those skilled in the art. A filter 93 can also be incorporated in the water line 89 to filter water from the household water system before the water is delivered to the reservoir 88.

The reservoir 88 is in fluid communication with the ice-making unit so that water from the reservoir may be delivered to the ice-making tray 82 of the ice-making unit and water from the ice-making unit may be returned to the reservoir. Specifically, a pump 94 operatively associated with the reservoir 88 and the ice-making tray 82 of the ice-making unit pumps water from the reservoir 88 to the ice-making tray 82 through water line 95. Additionally, excess water collected in the collection area 84 and water from melted ice in the ice-storage area 86 are returned to the reservoir 88 through water lines 96 and 97, respectively Thus, water is delivered to the reservoir 88 from three sources: the household water system 90; the collection area 84; and the ice-storage area 86. The float valve 91 is effective in insuring that the water will not overflow the reservoir 88, a circumstance that can develop if there is a power failure and there is a significant amount of ice that melts in the ice-storage area.

The operation of the pump 94 is controlled by the microprocessor in a manner familiar to those skilled in the art. The microprocessor can be set at the control panel 36 and typically will be set so that the pump will run a sufficient period of time to completely fill the tray 82 with water. If desired, so as to insure that the tray is completely filled, the microprocessor can be set so that the pump will pump water from the reservoir 88 to an extent that the water will overflow the ice-making tray 82. The overflow water is collected in the collection area 84. At least one opening 85 through which water may pass is provided in the collection area 84 and the at least one opening is in fluid communication with the reservoir 88 through water line 96 for returning water from the collection area 84 to the reservoir 88.

Again with reference to FIG. 9, ice pieces are made in the ice-making unit from the pool of water in the ice-making tray 82 that is provided from the reservoir 88. Thus as described above with reference to FIG. 10, the refrigerant after passing through the capillary tube 66 is provided to the plurality of ice-forming elements 83 that are disposed in the pool of water in the ice-making tray. The elements are made of a thermally conductive material that is resistant to corrosion from water or that is coated with a water-resistant coating. The refrigerant can either be brought into general contact with the elements 83, and the elements cooled thereby, or the refrigerant can be placed into more complete contact with the elements by passing the refrigerant internally of the elements. In any event, as a result of the action of the capillary tube 66 on the refrigerant, the refrigerant will be at a temperature sufficiently low to cause the water in the pool of water in the ice-making tray 82 that is in the vicinity of the ice-forming elements 83 to freeze. As the refrigerant contacts the ice-forming elements 83, pieces of ice are formed on the elements. When a preset period of time has passed, the microprocessor will actuate the servo device 69 causing the valve 68 in the line 67 of the refrigeration system to open and at least a portion of the hot or warm compressed refrigerant from the compressor 52 or 52B will flow through the ice-forming elements 83. The length of time the refrigerant is in contact with the ice-forming elements is dependent largely on the size of ice pieces that are desired, and the time is controlled by the microprocessor based on information that is input to the microprocessor at the panel 36. The ice-making cycle can be controlled by other means such as a timing mechanism that is operated based on a user input, for example, provided at the panel 36. The timing mechanism controls the operation of the servo device 69. Thus, when it is desired to make ice, the user will set the timing mechanism for the time period ice is to be formed, depending on the size of the ice pieces that are desired.

The direct cooling of the water in the ice-making tray 82 by the ice-forming elements 83 is a particularly effective method of forming ice. Ice can be formed more quickly than by the method of cooling the water by convection using cold air. Additionally, cooling of water by cold air convection causes ice pieces to be formed from the outside to the inside of the pieces, resulting in the cracking of the ice pieces and resulting in the ice pieces taking on a cloudy appearance. On the other hand cooling of the water by the ice-forming elements 83 causes the ice pieces to be formed from the inside to the outside of the pieces and cracking of the ice pieces is significantly reduced. Further, the method of forming ice in accordance with the invention allows the user to have the ice be soft or hard as desired. The ice pieces will be softer the greater the temperature of the refrigerant coming into contact with the ice-forming elements 83. One way of controlling the temperature of the refrigerant is to use a capillary tube that has an orifice consistent with the type of ice it is desired to make. As is known to those skilled in the art, the size of the orifice influences the temperature of the refrigerant as it exits the capillary tube. Another way of controlling the temperature of the refrigerant is to use a variable expansion device in place of the capillary tube 66.

As the hot or warm compressed refrigerant contacts the ice-forming elements 83, the bond causing the ice pieces to adhere to the ice-forming elements will be broken and the ice pieces will be freed from the plurality of ice-making elements. However, prior to this occurring, as controlled by the microprocessor, a dumping mechanism operatively associated with the ice-making tray 82 will rotate the ice-making tray and dump from the ice-making tray any water in the ice-making tray that has not been converted to ice. The water that is dumped falls to the collection area 84, as indicated by the directional arrow 100 in FIG. 9 and passes through the at least one opening 85 in the collection area and is returned to the reservoir 88 through water line 96.

The rotation of the ice-making tray 82 results in the tray being rotated out from under the ice pieces so that when the ice pieces are freed from the ice-making elements 83 by the warm refrigerant, the ice pieces will fall to the collection area 84 as indicated by the directional arrow 101 in FIG. 9. A device further described below and located in the collection area moves the ice pieces from the collection area to an ice storage area 86 as indicated by the directional arrow 102 in FIG. 9. The ice storage area includes at least one opening 103 through which water may pass and the at least one opening is in fluid communication with the reservoir 88 by means of water line 97 for returning water from the ice storage area 86 to the reservoir. Water in the ice storage area is generated primarily as a result of the ice pieces melting because the ice-making unit, including the ice storage area 86 and the ice pieces stored therein are exposed to an environment where the ambient air is at a temperature above zero degrees Centigrade, such as the fresh food compartment of the refrigerator 10.

The ice storage area 86 and the reservoir 88 are operatively associated with the dispensing port 18 in the door 14 of the fresh food compartment of the refrigerator 10 as indicated by the directional arrows 104 and 105, respectively, so that the ice pieces and cold water may be dispensed through the dispensing port 18.

Figure 5:
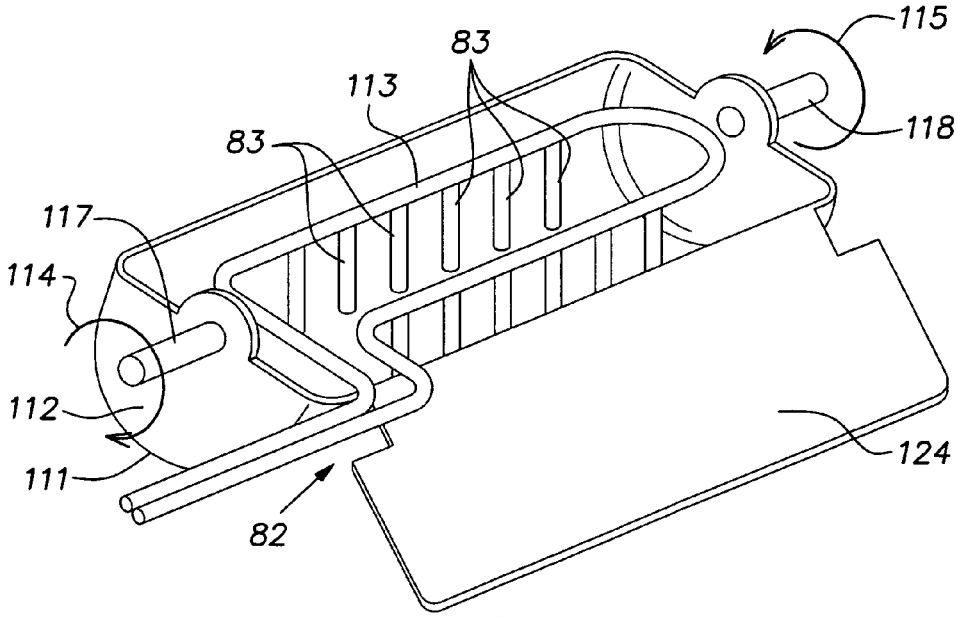
FIG. 5 is a perspective view of an embodiment of the ice-making tray of the ice-making system of the invention.

An embodiment of the ice-making system of the present invention that is capable of carrying out the operational aspects described above with reference to FIG. 9 is best described with reference to FIGS. 5 through 8 of the drawings. As can be seen in FIG. 5, the ice-making tray 82 of the ice-making unit has a closed bottom 111 and a closed perimeter of walls 112 extending away from the closed bottom of the tray so as to define an enclosed space for holding water when the tray is an upright position. The plurality of ice-forming elements 83 arranged in two rows are supported from a manifold 113 so as to extend into the enclosed space defined by the tray 82. As indicated above, the elements 83, as well as the manifold 113, are made of a material such as stainless steel that is capable of transmitting heat and cold. The elements are adapted to be operatively associated with the refrigeration system in a manner that a cooling effect may be transmitted to the elements for the formation of ice pieces in the enclosed space defined by the ice-making tray 82 and a heating effect may be transmitted to the elements for freeing the ice pieces from the elements 83. In this regard, the manifold 113, can comprise a hollow tubing and thereby constitute the evaporator 51 whereby the elements 83 are cooled sufficiently for the ice pieces to be formed on the elements 83 and subsequently heated to break the bond by which the ice pieces adhere to the elements 83. The ice-forming elements 83 can be constructed in a manner that the refrigerant flows internally of at least a portion of each element or the elements can comprise solid sections of the heat-transferable material.

Figure 6:
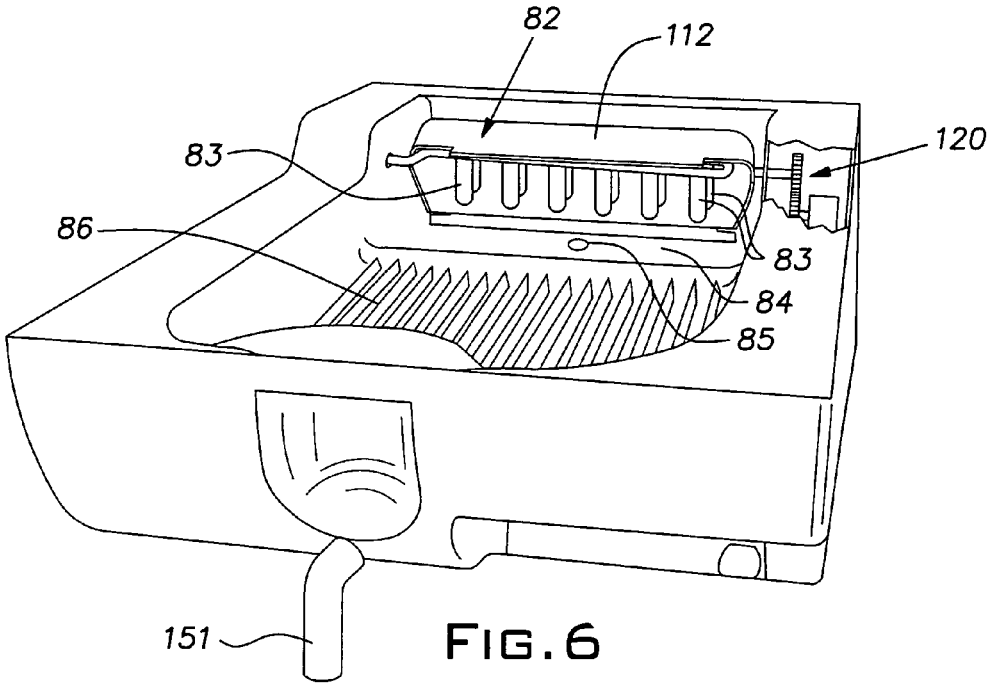
FIG. 6 is a perspective view of an embodiment of the ice-making system of the invention shown in the operational condition wherein the ice tray of the ice-making unit of the ice-making system in which ice pieces are formed has been rotated away from the ice-forming elements on which the ice pieces are formed, whereby any water in the ice tray that has not been formed into ice pieces has been released or dumped and with a portion of the ice-making unit broken away to illustrate certain internal components of the unit.

FIG. 6 depicts the ice-making system in a condition where the ice-making tray 82 has been rotated backward approximately ninety degrees, as indicated by the directional arrow 114 in FIG. 5, from a position where the ice-making elements 83 are located within the ice-making tray to a position where the ice-making tray has moved out from under the ice-making elements and the ice pieces formed on the ice elements 83 are able to be harvested. So that the invention can be more clearly seen and understood, the paddle 124 attached to the tray 82 is not shown in FIG. 6 and none of the figures include a depiction of the ice pieces either when they are adhering to the elements 83, when they are in the collection area 84 or when they are in the storage area 86.

Figure 7:
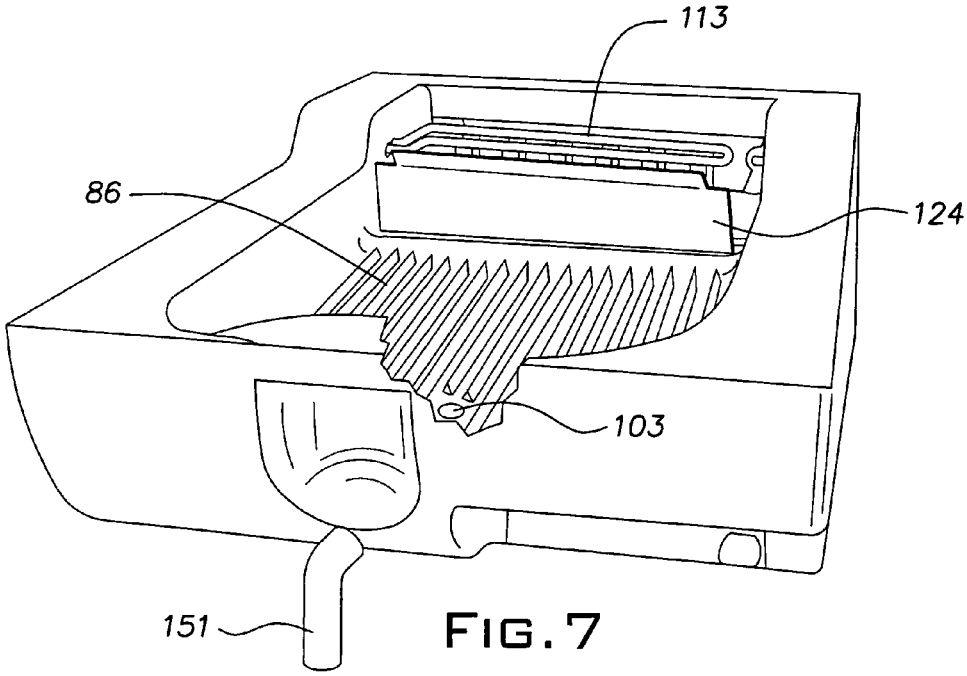
FIG. 7 is a perspective view of the embodiment of the ice-making system of FIG. 6 shown in the operational condition wherein the ice tray has been rotated from the operational condition shown in FIG. 6 back to a position beneath the ice-forming elements where the ice pieces that have initially fallen to a collection area in the ice-making unit have been moved to an ice storage area in the ice-making unit and with a portion of the ice-storage area broken away to illustrate an opening in the ice-storage area for the passage of water.

The ice-making unit also includes a dumping mechanism operatively associated with the ice-making tray 110 for rotating the ice-making tray. In one instance, as indicated above, when the ice pieces have been formed on the elements 83 and are to be harvested, the dumping mechanism will rotate the ice tray 110 backward approximately ninety degrees to the position shown in FIG. 6. In a second instance, after the ice pieces have been harvested, the dumping mechanism will rotate the ice tray forward, as indicated by the directional arrow 115 in FIG. 5, approximately ninety degrees and return the ice tray to a position beneath the elements. This operational condition is shown in FIG. 7. The dumping mechanism includes the rods 117 and 118 that are fastened to respective sides of the ice-making tray and are journaled at opposite sides of the ice-making unit. The rod 118 is operatively associated with a gearing mechanism, indicated generally at 120, that is housed in the ice-making unit for rotating the rod 118 and, thereby, the tray 82. Upon initial activation of the gearing mechanism, after the ice pieces have formed on the elements 83, the ice tray 82 will rotate backward approximately ninety degrees to the position shown in FIG. 6 and as the tray rotates any water that has not frozen is dumped from the ice tray to the collection area 84. At the same time, the valve 68 in conduit 67 of the refrigeration system is opened to the flow of warm or hot compressed refrigerant from compressing unit 52 or 52B. After passing through opened valve 68, the warm or hot compressed refrigerant flows through the manifold 113, contacts the ice-forming elements 83 and increases the temperature of the elements so as to break the bond causing the elements and the ice pieces formed on the elements to adhere to one another. As a result, the ice pieces fall to the collection area 84.

The collection area 84 in the illustrated embodiment of the invention, as best seen in FIG. 6 comprises a basin with an opening 85 at the bottom of the basin through which water dumped from the tray, but not the ice pieces, may pass. The opening 85 in the collection area is in fluid communication with the water reservoir 88, as further described below, so that water entering the collection area may be returned to the reservoir.

The ice-making unit also includes an ice storage area 86 where the ice pieces can be stored. Ice pieces formed in the ice-making tray and collected in the collection area 84 are moved from the collection area to the ice storage area 86 by a device in the form of a rotating paddle 124 that physically engages the ice in the collection area and sweeps the ice from the collection area to the ice storage area. As best seen in FIG. 5, the rotating paddle 124 is attached to the forward side of the ice tray and extends along the entire length of that side of the tray so that the paddle will influence all the ice pieces in the collection area 84 as it rotates together with the tray 82. At such time as the gearing mechanism 120 is activated to rotate the ice tray from the position shown in FIG. 6 to a position for making ice, with the ice-making elements 83 once again positioned within the tray, as shown in FIG. 7, the paddle 124 will rotate up out of the basin comprising the collection area 84, pushing forward the ice pieces in the collection area and the ice pieces will be deposited in the ice storage area 86.

Because the ice storage area 86, generally, will be exposed to the temperature of the fresh food compartment, a temperature that will be somewhat greater than zero degrees Centigrade, the ice pieces in the ice storage area, if not promptly removed, will gradually melt. An opening 103 is provided in the ice storage area 86 through which the water created by the melting ice will pass. This opening is in fluid communication with the reservoir 88 so that the water can be returned to the reservoir. As noted above, the ice-making unit can include a cover as shown at 81 in FIG. 2. The cover covers at least the ice storage area 86 and limits the amount of moisture that can pass from the ice-making unit to the fresh food compartment.

In the embodiment of the invention shown in the drawings, the water reservoir 88, as best seen in FIG. 8, is contained within a housing 130 that forms the bottom section of the ice-making system 80 and on which the top section of the ice-making unit, with the ice-making tray, the collection area and the ice storage area, rest. The housing 130 also contains the water filter 93 and the pump 94. Water from the household source of water 90 is delivered to the reservoir 88 through water line 89 in which the filter is located. The pump 94 serves to pump water from the reservoir 88 to the ice-making tray 82 through water line 95. Water is returned to the reservoir from the opening 85 in the collection area 84 and the opening 103 in the ice storage area 86 through water lines 96 and 97, respectively. Alternatively, the water returned to the reservoir 88 from the collection area 84 and the storage area 86 can be first directed to the filter 93. In either event, maintaining the reservoir 88 and the water lines between the reservoir and the collection area 84 and the storage area 86 within the fresh food compartment will tend to keep the water in the reservoir cold. This condition is enhanced because the water dumped from the ice tray 82 and the water from the melting of the ice pieces in the storage area 86 will be cold. As a result, less energy will be required to form ice using the water from the reservoir 88. Additionally, the ice pieces taken from the ice-storage area 86 will tend to be fresher since the older ice pieces remaining in storage for an extended period of time will have melted.

The water reservoir 88, rather than being housed within the housing 130, can be located proximate a food or beverage storage unit whereby the storage unit is cooled by the water in the reservoir. One example of such an arrangement of the water reservoir is shown in FIG. 11. In this embodiment, the reservoir comprises a molded plastic container, indicated generally at 88A, the walls of which have an inside surface 140 that is in contact with and confines the water in the reservoir and an outer surface 142. As illustrated in FIG. 11, the walls of the reservoir are configured so that the storage unit 144, shown with its front door removed, is at least partially contained within the confines of the outer surface 142 of the walls of the reservoir. In other words, the reservoir 88A substantially envelops the storage unit whereby the storage unit is cooled by the water in the reservoir. A fan 145 is operatively associated with the storage unit for circulating air within the storage unit. As an alternative, the reservoir can be used with a food storage unit in the form of a "crisper" pan (not shown) familiar to those having ordinary skill in the art.

The water in the reservoir 88 also can be a source of drinking water that is dispensed through the dispensing port 18 in the door 14. The water flows to the dispensing port along a water dispensing path that extends between the dispensing port and the reservoir. In the embodiment of the invention shown in the drawings, the water-dispensing path is arranged so as to be located essentially entirely within the fresh food compartment prior to entering the dispensing port. Specifically, with reference to FIGS. 1, 2 and 8, a water line 150 is provided between reservoir 88 and the front of the outside of the housing 130. The water line 150 terminates outside the housing 130 at a nozzle 151 with the nozzle extending away from the housing 130 a sufficient distance that, when the door 14 is closed, water exiting the line 150 through the nozzle 151 is directed into the opening 31 in the funnel 30. A solenoid valve 152 is located in the water line 150 and is operatively associated with a lever, or the like, located in the port 18 so that when the lever is moved, as by pushing a water glass against it, a circuit controlling the solenoid valve 152 will be energized and the solenoid valve 152 will be opened so that water may flow to the funnel 30.

Ice also can be dispensed through the dispensing port 18. To accomplish this, a suitable mechanism is provided for transporting the ice from the ice storage area 86 to the opening 31 in the funnel 30.

Based on the foregoing description, it can be seen that the present invention, among its various aspects, provides a method of operating a refrigeration appliance having a freezer compartment and a fresh food compartment in which an ice-making unit is located and wherein the freezer compartment and the fresh food compartment are in fluid communication with one another so that air may be circulated between the freezer compartment and the fresh food compartment. The method involves providing to the freezer compartment a cooling effect sufficient to maintain the freezer compartment at a temperature of zero degrees Centigrade or less and circulating air between the freezer compartment and the fresh food compartment while maintaining the fresh food compartment at a temperature greater than zero degrees Centigrade. A cooling effect separate from the cooling effect provided to the freezer compartment is provided to the ice-making unit in the fresh food compartment, the separate cooling effect being sufficient to freeze water and form ice in the ice-making unit. In a particular embodiment of the method, the cooling effect to the freezer compartment is provided by means of a first evaporator and the cooling effect to the ice-making unit is provided by means of a second evaporator. Additionally, in accordance with an embodiment of the invention, the cooling effect to the ice-making unit is discontinued when ice is not being formed in the ice-making unit. In accordance with a further embodiment of the invention, the cooling effect to the freezer is discontinued for at least a portion of the time that the cooling effect is provided to the ice-making unit.

It can also be seen, based on the description of the invention set forth above, that the method discussed in the preceding paragraph can include the manufacture of ice pieces in the ice-making unit. The ice pieces can be made by providing from a source of water a pool of water within an ice-making tray in the ice-making unit and providing a refrigerant to a plurality of ice-forming elements that are disposed in the pool of water. The ice-forming elements are made of a material that is a thermal conductor and the refrigerant is at a temperature sufficiently low to freeze water in the vicinity of the ice-forming elements. As a result, ice pieces are formed on the plurality of ice-forming elements. Water that has not been made into ice is released from the ice-making tray and the ice pieces are freed from the plurality of ice-forming elements. In a particular embodiment of the invention, the ice pieces are freed by providing to the ice-forming elements a refrigerant that is at a temperature sufficiently great to break the bond causing the ice pieces to adhere to the ice-forming elements. The method additionally involves allowing the freed ice pieces to fall and be initially collected in a collection area below the ice-making tray. The ice pieces can be moved from the collection area to an ice storage area located in the fresh food compartment.

The method also can involve employing a reservoir of water as the source of water and providing water to the ice-making tray from the reservoir to an extent that the water overflows the ice-making tray. At least a portion of the water that overflows the ice-making tray, as well as water flowing to the collection area as a result of the dumping of water from the tray and water resulting from the melting of ice in the ice storage area, is returned to the reservoir of water.

In a further aspect of the method, water from the water reservoir is dispensed as drinking water. Further, a food or beverage cooling unit can be cooled by means of the water reservoir.

The invention has been described with respect to various specific embodiments. However, it will be recognized by those skilled in the art that the invention can be practiced with modifications that are within the spirit and scope of the claims that follow.

What is claimed is:

1. A refrigeration appliance comprising:

a freezer compartment maintained at a temperature of zero degrees Centigrade or less and a fresh food compartment maintained at a temperature greater than zero degrees Centigrade;

the freezer compartment and the fresh food compartment being in fluid communication with one another whereby air may be circulated between the freezer compartment and fresh food compartment;

a separate access door provided to each of the freezer compartment and the fresh food compartment, each separate access door being exposed to an ambient environment of the refrigeration appliance and openable to grant access to one of the freezer compartment and the fresh food compartment without exposing another of the freezer compartment and the fresh food compartment to the ambient environment;

an air mover for circulating air between the freezer compartment and the fresh food compartment;

an ice-making unit located in the fresh food compartment and including an ice-making tray adapted to contain a pool of water and a plurality of ice-forming elements disposed in the pool of water, the ice-making unit and the ice made in the ice-making unit being exposed to the temperature in the fresh food compartment, the ice-making unit further including:

a dumping mechanism operatively associated with the ice-making tray for rotating the ice-making tray about the ice-making elements, the dumping mechanism including at least one rod coupled to a side of the ice-making tray and having a longitudinal axis, the ice-making tray rotating about the longitudinal axis of the rod from a first position where the ice-making elements are located within the ice-making tray to a second position where the ice-making tray has rotated out from under the ice-making elements and ice pieces formed on the ice elements are able to be harvested; and a refrigeration system in operative association with the freezer compartment and the ice-making unit for furnishing to the freezer compartment a cooling effect sufficient to maintain the freezer compartment at a temperature of zero degrees Centigrade or less and for separately furnishing to the ice-making unit a cooling effect sufficient to freeze water and form ice in the ice-making unit, the refrigeration system further including:

a first evaporator in operative association with the freezer compartment for furnishing to the freezer compartment a cooling effect sufficient to maintain the freezer compartment at a temperature of zero degrees Centigrade or less; and a second evaporator in operative association with the ice-making unit for furnishing to the ice-making unit a cooling effect sufficient to freeze water and form ice in the ice-making unit, the second evaporator providing a refrigerant to the plurality of ice-forming elements that are disposed in the pool of water, the ice-forming elements being made of a material that is a thermal conductor and the refrigerant being at a temperature sufficiently low to cause the water in the vicinity of the ice-forming elements to freeze and form the ice pieces on the plurality of ice-forming elements.

2. The refrigeration appliance of claim 1 including:

a heat-supplying arrangement in operative association with the ice-making unit for selectively furnishing to the ice-making unit a heating effect sufficient to free ice formed in the ice-making unit from any surface in the ice-making unit to which the ice may adhere.

3. The refrigeration appliance of claim 2 wherein:

the refrigeration system in addition to including the first evaporator and the second evaporator includes a compressing unit, a condensing unit and a refrigerant;

each of the compressing unit, the condensing unit, the first evaporator and the second evaporator has an entry side for the entry of the refrigerant and an exit side for the exiting of the refrigerant;

the exit side of the compressing unit is in fluid communication with the entry side of the condensing unit;

each of the entry side of the first evaporator and the entry side of the second evaporator is in fluid communication with the exit side of the condensing unit; and each of the exit side of the first evaporator and the exit side of the second evaporator is in fluid communication with the entry side of the compressing unit.

4. The refrigeration appliance of claim 3 wherein the refrigeration system further includes:

a first capillary tube located between the exit side of the condensing unit and the entry side of the first evaporator so as to control the flow of the refrigerant to the first evaporator from the condensing unit and the temperature of the refrigerant in the first evaporator; and a second capillary tube located between the exit side of the condensing unit and the entry side of the second evaporator so as to control the flow of the refrigerant to the second evaporator from the condensing unit and the temperature of the refrigerant in the second evaporator; and wherein the first capillary tube and the second capillary tube are of such respective sizes that the temperature of the refrigerant in the second evaporator is greater than the temperature of the refrigerant in the first evaporator.

5. The refrigeration appliance of claim 3 wherein the heat-supplying arrangement in operative association with the ice-making unit for selectively furnishing to the ice-making unit a heating effect sufficient to free ice formed in the ice-making unit from any surface in the ice-making unit to which the ice may adhere comprises:

a fluid conduit connected to the exit side of the compressing unit and the entry side of the second evaporator for placing the exit side of the compressing unit in fluid communication with the entry side of the second evaporator whereby at least a portion of the refrigerant from the compressing unit may bypass the condensing unit and flow from the exit side of the compressing unit to the entry side of the second evaporator; and a valve in operative association with the fluid conduit for selectively opening and closing the fluid conduit to the flow of the refrigerant from the exit side of the compressing unit to the entry side of the second evaporator.

6. The refrigeration appliance of claim 5 wherein the refrigeration system includes:

a control valve for the second evaporator in operative association with the condensing unit and the second evaporator for selectively opening and closing off the flow of the refrigerant to the second evaporator from the condensing unit.

7. The refrigeration appliance of claim 6 wherein the refrigeration system includes:

a control valve for the first evaporator in operative association with the condensing unit and the first evaporator for selectively opening and closing off the flow of the refrigerant to the first evaporator from the condensing unit.

8. The refrigeration appliance of claim 5 wherein the refrigeration system includes:

a first capillary tube located between the exit side of the condensing unit and the entry side of the first evaporator so as to control the flow of the refrigerant to the first evaporator from the condensing unit and the temperature of the refrigerant in the first evaporator; and a second capillary tube located between the exit side of the condensing unit and the entry side of the second evaporator so as to control the flow of the refrigerant to the second evaporator from the condensing unit and the temperature of the refrigerant in the second evaporator; and wherein the first capillary tube and the second capillary tube are of such respective sizes that the temperature of the refrigerant in the second evaporator is greater than the temperature of the refrigerant in the first evaporator.

9. The refrigeration appliance of claim 8 wherein the refrigeration system includes:

a control valve for the second evaporator in operative association with the condensing unit and the second evaporator for selectively opening and closing off the flow of the refrigerant to the second evaporator from the condensing unit.

10. The refrigeration appliance of claim 9 wherein the refrigeration system includes:

a control valve for the first evaporator in operative association with the condensing unit and the first evaporator for selectively opening and closing off the flow of the refrigerant to the first evaporator from the condensing unit.

11. The refrigeration appliance of claim 1 including:

a reservoir located in the fresh food compartment for holding water, the reservoir and the ice-making unit together comprising an ice-making system, the reservoir being adapted to be in fluid communication with a source of water outside the refrigeration appliance whereby water from the source of water outside the refrigeration appliance may be delivered to the reservoir, and wherein the reservoir is in fluid communication with the ice-making unit both for the delivery of water from the reservoir to the ice-making unit and for the return of water from the ice-making unit to the reservoir.

12. The refrigeration appliance of claim 11 including:

a float valve operatively associated with the source of water outside the refrigeration appliance and the reservoir for controlling the delivery of water to the reservoir from the source of water outside the refrigeration appliance.

13. The refrigeration appliance of claim 12 including:

a pump operatively associated with the reservoir and the ice-making unit for pumping water from the reservoir to the ice-making unit.

14. The refrigeration appliance of claim 11 wherein the ice-making unit includes:

a collection area for collecting excess water from the ice-making tray and initially collecting the ice pieces after they are formed, the collection area including at least one opening through which the water may pass, and the at least one opening in the collection area being in fluid communication with the reservoir for returning the water from the collection area to the reservoir.

15. The refrigeration appliance of claim 14 wherein:

the ice-making unit includes an ice storage area for holding ice pieces formed by the ice-making unit.

16. The refrigeration appliance of claim 15 wherein the ice storage area includes:

at least one opening through which water may pass, the at least one opening in the ice storage area being in fluid communication with the reservoir for returning water from the ice storage area to the reservoir.

17. The refrigeration appliance of claim 16 including:

a device for moving the ice pieces from the collection area to the ice storage area.

18. The refrigeration appliance of claim 17 including:

a cover for the ice-making unit that covers at least the ice-storage area and limits the amount of moisture that can pass from the ice-making unit to the fresh food compartment.

19. The refrigeration appliance of claim 11 including:

a food or beverage storage unit located sufficiently proximate the reservoir so that the storage unit is cooled by the water in the reservoir.

20. A refrigeration appliance comprising:

a freezer compartment maintained at a temperature of zero degrees Centigrade or less and a fresh food compartment maintained at a temperature greater than zero degrees Centigrade;

the freezer compartment and the fresh food compartment being in fluid communication with one another whereby air may be circulated between the freezer compartment and fresh food compartment;

an air mover for circulating air between the freezer compartment and the fresh food compartment;

an ice-making unit located in the fresh food compartment, the ice-making unit and the ice made in the ice-making unit being exposed to the temperature in the fresh food compartment; and a refrigeration system in operative association with the freezer compartment and the ice-making unit for furnishing to the freezer compartment a cooling effect sufficient to maintain the freezer compartment at a temperature of zero degrees Centigrade or less and for separately furnishing to the ice-making unit a cooling effect sufficient to freeze water and form ice in the ice-making unit, a reservoir located in the fresh food compartment for holding water, the reservoir and the ice-making unit together comprising an ice-making system, the reservoir being adapted to be in fluid communication with a source of water outside the refrigeration appliance whereby water from the source of water outside the refrigeration appliance may be delivered to the reservoir, and wherein the reservoir is in fluid communication with the ice-making unit both for the delivery of water from the reservoir to the ice-making unit and for the return of water from the ice-making unit to the reservoir; and a food or beverage storage unit located sufficiently proximate the reservoir so that the storage unit is cooled by the water in the reservoir, wherein the reservoir includes walls having inside surfaces that are in contact with and confine the water in the reservoir and outer surfaces, the walls of the reservoir being configured so that the storage unit is at least partially contained within the confines of the outer surfaces of the walls of the reservoir whereby the storage unit is cooled by the water in the reservoir.

21. The refrigeration appliance of claim 20 including:

a fan operatively associated with the storage unit for circulating the air within the storage unit.

22. A refrigeration appliance comprising:

a freezer compartment maintained at a temperature of zero degrees Centigrade or less and a fresh food compartment maintained at a temperature greater than zero degrees Centigrade;

the freezer compartment and the fresh food compartment being in fluid communication with one another whereby air may be circulated between the freezer compartment and fresh food compartment;

an air mover for circulating air between the freezer compartment and the fresh food compartment;

an ice-making unit located in the fresh food compartment, the ice-making unit and the ice made in the ice-making unit being exposed to the temperature in the fresh food compartment; and a refrigeration system in operative association with the freezer compartment and the ice-making unit for furnishing to the freezer compartment a cooling effect sufficient to maintain the freezer compartment at a temperature of zero degrees Centigrade or less and for separately furnishing to the ice-making unit a cooling effect sufficient to freeze water and form ice in the ice-making unit, a reservoir located in the fresh food compartment for holding water, the reservoir and the ice-making unit together comprising an ice-making system, the reservoir being adapted to be in fluid communication with a source of water outside the refrigeration appliance whereby water from the source of water outside the refrigeration appliance may be delivered to the reservoir, and wherein the reservoir is in fluid communication with the ice-making unit both for the delivery of water from the reservoir to the ice-making unit and for the return of water from the ice-making unit to the reservoir; and a door for closing off as well as providing access to the fresh food compartment, a dispensing port in the door of the fresh food compartment and a water dispensing path extending between the dispensing port and the reservoir along which water from the reservoir may flow to the dispensing port.

23. The refrigeration appliance of claim 22 wherein:

the water-dispensing path is arranged so as to be located essentially entirely within the fresh food compartment prior to entering the dispensing port.

24. The refrigeration appliance of claim 1 wherein:

the compressing unit comprises a single compressor and the condensing unit comprises a single condenser.

25. The refrigeration appliance of claim 1 wherein:

the compressing unit comprises a first compressor and a second compressor, the first compressor being in fluid communication with the first evaporator and the second compressor being in fluid communication with the second evaporator.

26. The refrigeration appliance of claim 1 wherein:

the compressing unit comprises a variable speed compressor, the speed and capacity of which are matched to the loads developed by the freezer compartment and the fresh food compartment, including the ice-making unit, of the refrigeration appliance.

27. A refrigeration system adapted to be used with a refrigeration appliance that includes a freezer compartment maintained at a temperature of zero degrees Centigrade or less, a fresh food compartment maintained at a temperature greater than zero degrees Centigrade and an ice-making unit located in the fresh food compartment, the ice-making unit and the ice made in the ice-making unit being exposed to the temperature of the fresh food compartment, the refrigeration system comprising:

a refrigerant;

a compressing unit for compressing the refrigerant and having an entry side and an exit side;

a condensing unit for condensing the refrigerant after it has been compressed and having an entry side in fluid communication with the exit side of the compressing unit and an exit side;

a first evaporator having an entry side in fluid communication with the exit side of the condensing unit for receiving a first portion of the refrigerant and adapted to be operatively associated with the freezer compartment for furnishing a cooling effect to the freezer compartment sufficient to maintain the freezer compartment at a temperature of zero degrees Centigrade or less;

a second evaporator having an entry side in fluid communication with the exit side of the condensing unit independently of the first evaporator for receiving a second portion of the refrigerant and adapted to be operatively associated with the ice-making unit for furnishing a cooling effect to the ice-making unit sufficient to freeze water and form ice in the ice-making unit, the second evaporator providing the second portion of the refrigerant to an ice-making tray containing a pool of water, the second portion of the refrigerant being at a temperature sufficiently low to cause the water in the ice making tray, via a thermal conductor, to form ice pieces in the ice-making tray;

a fluid conduit connecting the exit side of the compressing unit and the entry side of the second evaporator for placing the exit side of the compressing unit in fluid communication with the entry side of the second evaporator whereby at least another portion of the refrigerant from the compressing unit may bypass the condensing unit and flow from the exit side of the compressing unit to the entry side of the second evaporator;

a valve operatively associated with the fluid conduit for selectively opening and closing the fluid conduit to the flow of compressed refrigerant from the exit side of the compressing unit to the entry side of the second evaporator;

a first capillary tube having an entry end and an exit end, the entry end of the first capillary tube being in fluid communication with the exit side of the condensing unit and the exit end of the first capillary tube being in fluid communication with the entry side of the first evaporator that is operatively associated to cool the freezer compartment; and a second capillary tube having an entry end and an exit end, the entry end of the second capillary tube being in fluid communication with the exit side of the condensing unit and the exit end of the second capillary tube being in fluid communication with the entry side of the second evaporator that is operatively associated to furnish the cooling effect to the ice-making unit, wherein the first capillary tube and the second capillary tube are of such respective sizes that the temperature of the refrigerant in the second evaporator is greater than the temperature of the refrigerant in the first evaporator when the refrigerant is being delivered to both the first and second evaporators.

28. The refrigeration system of claim 27 wherein:

the compressing unit comprises a single compressor and the condensing unit comprises a single condenser.

29. The refrigeration system of claim 27 wherein:

the compressing unit comprises a first compressor and a second compressor, the first compressor being in fluid communication with the first evaporator and the second compressor being in fluid communication with the second evaporator; and the fluid conduit connects the exit side of the second compressor and the entry side of the second evaporator.

30. The refrigeration system of claim 27 including:

a control valve for the second evaporator in operative association with the condensing unit and the second evaporator for selectively opening and closing off the flow of the refrigerant to the second evaporator from the condensing unit.

31. The refrigerator system of claim 30 including:

a control valve for the first evaporator in operative association with the condensing unit and the first evaporator for selectively opening and closing off the flow of the refrigerant to the first evaporator from the condensing unit.

32. The refrigeration system of claim 31 including:

a control mechanism operatively associated with the valve located in the fluid conduit for controlling the opening and closing of the valve for selected time periods.

33. The refrigeration system of claim 32 including:

a control valve for the second evaporator in operative association with the condensing unit and the second evaporator for selectively opening and closing off the flow of the refrigerant to the second evaporator from the condensing unit.

34. The refrigerator system of claim 33 including:

a control valve for the first evaporator in operative association with the condensing unit and the first evaporator for selectively opening and closing off the flow of the refrigerant to the first evaporator from the condensing unit.

35. An ice-making system comprising:

an ice-making unit adapted to operate within a section of a refrigeration appliance that is maintained at a temperature above zero degrees Centigrade and to be placed in operative association with a refrigeration system for furnishing to the ice-making unit a cooling effect sufficient to freeze water and form ice in the ice-making unit, the ice-making unit and the ice made in the ice-making unit being exposed to the temperature of the section of the refrigeration appliance that is maintained at a temperature above zero degrees Centigrade; and a reservoir for holding water, the reservoir being adapted to be located within the same section of the refrigeration appliance as the ice-making unit and further adapted to be in fluid communication with a source of water outside the refrigeration appliance whereby water from the source of water may be delivered to the reservoir, a valve for automatically controlling the delivery of water to the reservoir from the source of water outside the refrigerator appliance in response to the quantity of water in the reservoir, the reservoir being in fluid communication with the ice-making unit whereby water from the reservoir may be delivered to the ice-making unit and water from the ice-making unit may be returned to the reservoir, a filter disposed between the source of water outside the refrigerator appliance and the reservoir to filter water from the source of water outside the refrigerator before the water is delivered to the reservoir;

the ice-making unit further including an ice storage area for holding ice pieces formed by the ice-making unit, and the ice storage area including at least one opening through which water may pass, the at least one opening being in fluid communication with the reservoir for returning water from the ice storage area to the reservoir, such that said water returned from the ice storage area to the reservoir may be delivered to the ice-making unit;

the ice-making unit further including:

an ice-making tray adapted to contain a pool of water and a plurality of ice-forming elements disposed in the pool of water; and a dumping mechanism operatively associated with the ice-making tray for rotating the ice-making tray about the ice-making elements, the dumping mechanism including at least one rod coupled to a side of the ice-making tray and having a longitudinal axis, the ice-making tray rotating about the longitudinal axis of the rod from a first position where the ice-making elements are located within the ice-making tray to a second position where the ice-making tray has rotated out from under the ice-making elements and the ice pieces formed on the ice elements are able to be harvested.

36. The ice-making system of claim 35 wherein the valve is a float valve.

37. The ice-making system of claim 36 including:

a pump operatively associated with the reservoir and the ice-making unit for pumping and delivering water from the reservoir to the ice-making unit.

38. The ice-making system of claim 35 wherein:

the ice-making unit includes a collection area for collecting excess water from the ice-making tray and initially collecting the ice pieces, the collection area including at least one opening through which water may pass, the at least one opening being in fluid communication with the reservoir for returning water from the collection area to the reservoir.

39. The ice-making system of claim 38 including:

a device for moving the ice pieces from the collection area to the ice storage area.

40. The ice-making system of claim 39 including:

a cover for the ice-making unit that covers at least the ice-storage area and limits the amount of moisture that can pass from the ice-making unit to the fresh food compartment.

41. A method of operating a refrigeration appliance comprising a freezer compartment and a fresh food compartment in which an ice-making unit is located so that the ice-making unit and the ice pieces made thereby are exposed to the temperature in the fresh food compartment, the freezer compartment and the fresh food compartment each selectively enclosed by a separate access door but being in fluid communication with one another whereby air may be circulated between the freezer compartment and the fresh food compartment, wherein one of the separate access doors is openable to grant access to one of the freezer compartment and the fresh food compartment without exposing another of the freezer compartment and the fresh food compartment to the ambient environment, the method comprising:

providing to the freezer compartment a cooling effect sufficient to maintain the freezer compartment at a temperature of zero degrees Centigrade or less;

circulating air between the freezer compartment and the fresh food compartment while maintaining the fresh food compartment at a temperature greater than zero degrees Centigrade;

providing to the ice-making unit in the fresh food compartment a cooling effect separate from the cooling effect provided to the freezer compartment, the cooling effect provided to the ice-making unit being sufficient to freeze water and form the ice pieces in the ice-making unit, the cooling effect to the freezer compartment being provided by means of a first evaporator and the cooling effect to the ice-making unit being provided by means of a second evaporator, each of the first and second evaporators being independently supplied with first and second portions of a refrigerant, respectively, the method further including the steps of:

filtering water from a source of water outside the refrigerator appliance with a filter provided to the refrigeration along a water line extending between the source of water outside the refrigerator appliance and a reservoir for storing filtered water within the fresh food compartment of the refrigerator appliance;

providing from the reservoir a pool of filtered water within an ice-making tray in the ice-making unit;

providing the second portion of refrigerant, via the second evaporator, to a plurality of ice-forming elements that are disposed in the pool of filtered water, the ice-forming elements being made of a material that is a thermal conductor and the second portion of refrigerant being at a temperature sufficiently low to cause the filtered water in the vicinity of the ice-forming elements to freeze;

forming the ice pieces on the plurality of ice-forming elements;

rotating the ice-making tray about a longitudinal axis of at least one rod coupled to a side of the ice-making tray from a first position where the ice-making elements are located within the ice-making tray to a second position where the ice-making tray has rotated out from under the ice-making elements and ice pieces formed on the ice elements are able to be harvested;

releasing from the ice-making tray any filtered water that has not been made into ice;

freeing the ice pieces from the plurality of ice-forming elements; and at least a portion of the filtered water released from the ice-making tray is returned to the reservoir of water; and rotating the ice-making tray about the longitudinal axis of the at least one rod back to the first position.

42. The method of claim 41 wherein:

the cooling effect to the ice-making unit is discontinued when ice is not being formed in the ice-making unit.

43. The method of claim 42 wherein:

the cooling effect to the freezer compartment is discontinued for at least a portion of the time that the cooling effect is provided to the ice-making unit.

44. The method of claim 41 wherein the ice pieces are freed from the plurality of ice-forming elements by:

providing to the ice-forming elements another portion of refrigerant that is at a temperature sufficiently great enough to break the bond causing the ice pieces to adhere to the ice-forming elements.

45. The method of claim 44 wherein:

the cooling effect to the ice-making unit is discontinued when ice is not being formed in the ice-making unit.

46. The method of claim 45 wherein:

the cooling effect to the freezer compartment is discontinued for at least a portion of the time that the cooling effect is provided to the ice-making unit.

47. The method of claim 41 wherein:

water is provided to the ice-making tray from the reservoir of water to an extent that the water overflows the ice-making tray; and at least a portion of the water that overflows the ice-making tray is returned to the reservoir of water.

48. The method of claim 47 wherein;

the freed ice pieces are allowed to fall and are initially collected in a collection area of the ice-making unit located below the ice-making tray.

49. The method of claim 48 wherein;

the ice pieces are moved from the collection area to an ice storage area located in the fresh food compartment.

50. The method of claim 49 wherein;

any water resulting from the melting of the ice pieces in the ice storage area is returned to the reservoir of water.

51. A method of operating a refrigeration appliance having a freezer compartment and a fresh food compartment in which an ice-making unit is located so that the ice-making unit and the ice pieces made thereby are exposed to the temperature in the fresh food compartment, the freezer compartment and the fresh food compartment being in fluid communication with one another whereby air may be circulated between the freezer compartment and the fresh food compartment, the method comprising:

providing to the freezer compartment a cooling effect sufficient to maintain the freezer compartment at a temperature of zero degrees Centigrade or less;

circulating air between the freezer compartment and the fresh food compartment while maintaining the fresh food compartment at a temperature greater than zero degrees Centigrade;

providing to the ice-making unit in the fresh food compartment a cooling effect separate from the cooling effect provided to the freezer compartment, the cooling effect provided to the ice-making unit being sufficient to freeze water and form the ice pieces in the ice-making unit, wherein the cooling effect to the freezer compartment is provided by means of a first evaporator and the cooling effect to the ice-making unit is provided by means of a second evaporator, wherein the ice pieces are made in the ice-making unit by:

providing from a source of water a pool of water within an ice-making tray in the ice-making unit;

providing a refrigerant to a plurality of ice-forming elements that are disposed in the pool of water, the ice-forming elements being made of a material that is a thermal conductor and the refrigerant being at a temperature sufficiently low to cause the water in the vicinity of the ice-forming elements to freeze;

forming the ice pieces on the plurality of ice-forming elements;

releasing from the ice-making tray any water that has not been made into ice; and freeing the ice pieces from the plurality of ice-forming elements, wherein the ice pieces are freed from the plurality of ice-forming elements by:

providing to the ice-forming elements a refrigerant that is at a temperature sufficiently great enough to break the bond causing the ice pieces to adhere to the ice-forming elements, wherein the source of water is a reservoir of water located in the fresh food compartment of the refrigeration appliance; and at least a portion of the water released from the ice-making tray is returned to the reservoir of water, wherein water is provided to the ice-making tray from the reservoir of water to an extent that the water overflows the ice-making tray; and at least a portion of the water that overflows the ice-making tray is returned to the reservoir of water, wherein the freed ice pieces are allowed to fall and are initially collected in a collection area of the ice-making unit located below the ice-making tray, wherein the ice pieces are moved from the collection area to an ice storage area located in the fresh food compartment, wherein any water resulting from the melting of the ice pieces in the ice storage area is returned to the reservoir of water, and the method further including the step of dispensing water from the water reservoir through a dispensing port in a door that closes off the fresh food compartment to the ambient air in which the refrigeration appliance is located.

52. The method of claim 51 including;

using the water reservoir to cool a food or beverage cooling unit.

53. The ice-making system of claim 35, wherein water passing through the at least one opening included in the ice storage area is filtered by the filter in fluid communication with the reservoir before being returned to the reservoir to be subsequently delivered to the ice-making unit.

54. The method of claim 41, further including the step of filtering at least a portion of the filtered water released from the ice-making tray that is being returned to the reservoir with the filter provided to the refrigeration appliance to filter the water from the source of water outside the refrigerator appliance.

55. The refrigeration appliance of claim 1, further including a gearing mechanism operatively associated with the rod and adapted to rotate the rod to thereby rotate the ice-making tray.

56. The refrigeration appliance of claim 55, further including a collection area for initially collecting the ice pieces after they are formed, and a device for moving the ice pieces from the collection area to an ice storage area, the device being operatively associated with the gearing mechanism.

57. The refrigeration appliance of claim 1, wherein the freezer compartment and the access door provided to the freezer compartment are arranged substantially vertically below the fresh food compartment and the door provided to the fresh food compartment.

58. The refrigeration appliance of claim 57 further comprising a dispensing port formed in the access door provided to the fresh food compartment in communication with the ice-making unit to dispense ice from the ice-making tray to the ambient environment.

* * * * *